US006136769A

United States Patent [19]

Asano et al.

[11] Patent Number: 6,136,769

[45] Date of Patent: Oct. 24, 2000

[54] ALKOXYLATED CATIONIC DETERGENCY INGREDIENTS

[75] Inventors: Kaori Asano, Hyogo, Japan; Stuart Clive Askew, Newcastle Upon Tyne, United Kingdom; Hajime Baba, Kobe, Japan; André Cesar Baeck, Bonheiden; Jean-Luc Bettiol, Brussels, both of Belgium; Thomas Anthony Cripe, Loveland; Laura Cron, Fairfield, both of Ohio; Ian Martin Dodd, Loughborough, United Kingdom; Peter Robert Foley, Cincinnati, Ohio; Richard Timothy Hartshorn, Wylam; Lynda Anne (Jones) Speed, Gosforth, both of United Kingdom; Rinko Katsuda, Kobe, Japan; Frank Andrej Kvietok, Cincinnati, Ohio; Kaori Minamikawa, Hyogo; Mark Hsiang-Kuen Mao, Kobe, both of Japan; Michael Alan John Moss, Rome, Italy; Susumu Murata, Cincinnati, Ohio; Royohei Ohtani, Hyogo; Mitsuyo Okamoto, Ashiya, both of Japan; Rajan Keshav Panandiker; Kakumanu Pramod, both of West Chester, Ohio; Khizar Mohamed Kahn Sarnaik, Kobe, Japan; Jeffrey John Scheibel, Loveland, Ohio; Christiaan Arthur Jacques Kamiel Thoen, West Chester, Ohio; Kenneth William Willman, Fairfield, Ohio

[73] Assignee: The Procter & Gamble Company, Cincinnati, Ohio

[21] Appl. No.: 09/295,421

[22] Filed: Apr. 21, 1999

Related U.S. Application Data

[63] Continuation of application No. 09/180,961, filed as application No. PCT/US97/08442, May 16, 1997, abandoned

[60] Provisional application No. 60/017,886, May 17, 1996.

[51] Int. Cl.[7] ..... C11D 1/62; C11D 1/65; C11D 3/08

[52] U.S. Cl. ..... 510/329; 510/235; 510/276; 510/320; 510/327; 510/330; 510/332; 510/504

[58] Field of Search ..... 510/235, 276, 510/320, 327, 329, 330, 332, 504

[56] References Cited

U.S. PATENT DOCUMENTS

| | | | |
|---|---|---|---|
| 3,668,136 | 6/1972 | Barker | 252/117 |
| 4,033,718 | 7/1977 | Holcombe et al. | 8/103 |
| 4,203,872 | 5/1980 | Flanagan | 252/542 |
| 4,210,161 | 7/1980 | Wagman | 132/7 |
| 4,259,217 | 3/1981 | Murphy | 252/547 |
| 4,302,364 | 11/1981 | Gosset et al. | 252/545 |
| 4,333,862 | 6/1982 | Smith et al. | 252/547 |
| 4,347,168 | 8/1982 | Murphy et al. | 252/547 |
| 4,481,129 | 11/1984 | Oakes | 252/186.41 |
| 4,525,200 | 6/1985 | Kimpara et al. | 71/76 |
| 4,661,289 | 4/1987 | Parslow | 252/547 |
| 4,751,009 | 6/1988 | Damaso et al. | 252/8.75 |
| 4,851,138 | 7/1989 | Jaroschek et al. | 252/88 |
| 4,877,896 | 10/1989 | Maldonado et al. | 560/14 |
| 4,919,839 | 4/1990 | Durbut et al. | 252/153 |
| 5,290,475 | 3/1994 | Wixon | 252/174.23 |
| 5,415,807 | 5/1995 | Gosselink et al. | 252/174.21 |
| 5,441,541 | 8/1995 | Mehreteab | 8/137 |
| 5,670,466 | 9/1997 | Sivik et al. | 510/102 |
| 5,695,679 | 12/1997 | Christie et al. | 252/186.26 |
| 5,721,202 | 2/1998 | Waite et al. | 510/102 |
| 5,731,279 | 3/1998 | Pancheri | 510/340 |
| 5,759,208 | 6/1998 | Zhen et al. | 8/137 |

FOREIGN PATENT DOCUMENTS

| | | | |
|---|---|---|---|
| 0002084 | 5/1979 | European Pat. Off. | C11D 1/00 |
| 0003861 | 5/1979 | European Pat. Off. | C11D 3/395 |
| 0008142 | 2/1980 | European Pat. Off. | C11D 1/86 |
| 0026013 | 4/1981 | European Pat. Off. | C11D 1/835 |
| 0026529 | 4/1981 | European Pat. Off. | C11D 1/62 |
| 0035470 | 9/1981 | European Pat. Off. | C11D 3/395 |
| 0087914 | 9/1983 | European Pat. Off. | C11D 1/65 |
| 0095205 | 11/1983 | European Pat. Off. | C11D 1/65 |
| 0108180 | 5/1984 | European Pat. Off. | C11D 3/40 |
| 0163910 | 12/1985 | European Pat. Off. | C11D 3/00 |
| 0199403 | 10/1986 | European Pat. Off. | C11D 1/83 |
| 0257861 | 3/1988 | European Pat. Off. | C11D 1/62 |
| 0266931 | 5/1988 | European Pat. Off. | C11D 1/65 |
| 0294893 | 12/1988 | European Pat. Off. | C11D 1/40 |
| 0379312 | 7/1990 | European Pat. Off. | C11D 3/395 |
| 0456569 | 11/1991 | European Pat. Off. | C11D 3/37 |
| 0495554 | 7/1992 | European Pat. Off. | C11D 3/386 |
| 0512533 | 11/1992 | European Pat. Off. | C11D 3/39 |
| 0688859 | 12/1995 | European Pat. Off. | C11D 17/00 |
| 81/0023884 | 2/1981 | Japan | C11D 1/38 |
| 59/059793 | 4/1984 | Japan | C11D 1/65 |
| 2054635 | 2/1981 | United Kingdom | C11D 1/29 |
| 2040990 | 10/1982 | United Kingdom | C11D 1/00 |
| WO 95/29218 | 11/1995 | WIPO | C11D 1/65 |
| WO 95/33033 | 12/1995 | WIPO | C11D 1/65 |
| WO 97/43364 | 11/1997 | WIPO | C11D 1/62 |
| WO 97/43365 | 11/1997 | WIPO | C11D 1/62 |
| WO 97/43371 | 11/1997 | WIPO | C11D 3/12 |
| WO 97/43387 | 11/1997 | WIPO | C11D 3/386 |
| WO 97/43388 | 11/1997 | WIPO | C11D 3/386 |
| WO 97/43389 | 11/1997 | WIPO | C11D 3/39 |
| WO 97/43390 | 11/1997 | WIPO | C11D 3/39 |
| WO 97/43393 | 11/1997 | WIPO | C11D 3/42 |
| WO 97/43394 | 11/1997 | WIPO | C11D 3/42 |
| WO 97/44418 | 11/1997 | WIPO | C11D 1/62 |
| WO 97/44419 | 11/1997 | WIPO | C11D 1/62 |
| WO 97/44425 | 11/1997 | WIPO | C11D 3/12 |
| WO 97/44431 | 11/1997 | WIPO | C11D 3/39 |
| WO 97/44432 | 11/1997 | WIPO | C11D 3/39 |

*Primary Examiner*—Yogendra Gupta
*Assistant Examiner*—Charles Boyer
*Attorney, Agent, or Firm*—Ian S. Robinson; Kim William Zerby; Steven W. Miller

[57] ABSTRACT

Alkoxylated cationic surfactants, and mixtures thereof, are used in detergent compositions.

9 Claims, No Drawings

ALKOXYLATED CATIONIC DETERGENCY INGREDIENTS

CROSS REFERENCE

This is a continuation under 35 USC §120 of application Ser. No. 09/180,961, filed Nov. 17, 1998; now abandoned which is the National Phase Entry under 35 USC §371 of PCT International Application Ser. No. PCT International application Ser. No. PCT/US97/08442, filed May 16, 1997; which claims priority to Provisional Application Ser. No. 60/017,886, filed May 17, 1996.

TECHNICAL FIELD

The present invention relates to detergent compositions which comprise selected ingredients, including selected alkoxylated quaternary ammonium compounds.

BACKGROUND OF THE INVENTION

The formulation of laundry detergents and other cleaning compositions presents a considerable challenge, since modem compositions are required to remove a variety of soils and stains from diverse substrates. Thus, laundry detergents, hard surface cleaners, shampoos and other personal cleansing compositions, hand dishwashing detergents and detergent compositions suitable for use in automatic dishwashers, and the like, all require the proper selection and combination of ingredients in order to function effectively. In general, such detergent compositions will contain one or more types of surfactants which are designed to loosen and remove soils and stains. However, the removal of body soils, greasy/oily soils and certain food stains quickly and efficiently can be problematic. Indeed, while some surfactants and surfactant combinations exhibit optimal performance on certain types of soils and stains, they can actually diminish performance on other soils. For example, surfactants which remove greasy/oily soils from fabrics can sometimes be sub-optimal for removing particulate soils, such as clay. While a review of the literature would seem to indicate that a wide selection of surfactants and surfactant combinations is available to the detergent manufacturer, the reality is that many such ingredients are specialty chemicals which are not suitable in low unit cost items such as home-use laundry detergents. The fact remains that most such home-use products such as laundry detergents still mainly comprise one or more of the conventional ethoxylated nonionic and/or sulfated or sulfonated anionic surfactants, presumably due to economic considerations and the need to formulate compositions which function reasonably well with a variety of soils and stains and a variety of fabrics.

Accordingly, there is a continuing search for improvements in detergents, especially laundry and dishwashing detergents and hard surface cleaners. However, the challenge to the detergent manufacturer seeking improved performance has been increased by various factors. For example, some non-biodegradable ingredients have fallen into disfavor. Effective phosphate builders have been banned by legislation in many countries. Costs associated with certain classes of surfactants have impacted their use. As a result, the manufacturer is somewhat more limited than the literature would suggest in the selection of effective, yet affordable, ingredients. Still, the consumer has come to expect high quality and high performance in such compositions even when conducting cleaning operations under sub-optimal conditions, e.g., laundering fabrics in cool or cold water.

The literature does suggest that various nitrogen-containing surfactants would be useful in a variety of cleaning compositions. Such materials, typically in the form of amino-, amido-, or quaternary ammonium or imidazolinium compounds, are often designed for specialty use. For example, various amino and quaternary ammonium surfactants have been suggested for use in shampoo compositions and are said to provide cosmetic benefits to hair. Other nitrogen-containing surfactants are used in some laundry detergents to provide a fabric softening and anti-static benefit. For the most part, however, the commercial use of such materials is rather limited, and the aforementioned nonionic and anionic surfactants remain the major surfactant components in today's laundry compositions.

It has now been discovered that certain alkoxylated quaternary ammonium (AQA) compounds can be used in various detergent compositions to boost performance. Importantly, it has further been discovered that low levels of these AQA compounds provide superior cleaning performance when used in certain combinations with otherwise known or conventional ingredients. Thus, the present invention provides an improvement in cleaning performance without the need to develop new, expensive surfactant species.

Moreover, the AQA surfactants used in the present manner provide substantial advantages to the formulator over cationic surfactants known heretofore. For example, the AQA surfactants herein are compatible with the preferred alkyl sulfate and alkyl benzene sulfonate detersive surfactants. Moreover, the AQA surfactants are formulatable over a broad pH range from 5 to 12. The AQA surfactants can be prepared as 30% (wt.) solutions which are pumpable, and therefore easy to handle in a manufacturing plant. AQA surfactants with degrees of ethoxylation above 5 are sometimes in a liquid form and can be provided as 100% neat materials. In addition to their handling properties, the ability of the AQA surfactants herein to be provided as high concentrate solutions provides a substantial economic advantage in transportation costs. The AQA surfactants are also compatible with various perfume ingredients, unlike other quats known in the art.

In addition to the foregoing advantages, the AQA surfactants herein appear to minimize or eliminate redeposition of fatty acids/oily materials present in an aqueous laundry liquor back onto fabrics which have been previously soiled with body soils. Accordingly, the AQA surfactants herein have now been found to prevent the redeposition of polar lipids from an aqueous laundry bath back onto fabrics from whence body soils have been removed through the laundering process. Stated otherwise, in a laundering liquor, the AQA surfactants herein remove such polar lipids and keep them suspended in the aqueous medium, rather than allowing them to redeposit onto the cleaned fabrics.

In addition to the foregoing qualities, the AQA surfactants herein are surprisingly compatible with the polyanionic materials such as polyacrylates and acrylate/maleate copolymers which are used to provide a builder and/or dispersant function with many conventional detersive surfactants.

Other advantages for the AQA surfactants herein include their ability to enhance enzymatic cleaning and fabric care performance in a laundering liquor. While not intending to be limited by theory, it is speculated that enzymes may be partially denatured by conventional anionic surfactants. It is further speculated that the AQA surfactants herein somehow interact with the anionic surfactants to inhibit that degradation. An alternate theory would suggest that, even when enzymes are used to degrade soils and stains, the degraded residues must be removed from the fabric surface. It may be speculated that the improved detersive performance embodied in the mixture of AQA and anionic surfactants herein simply does a better job in removing these residues from the fabric surface.

In addition to the foregoing advantages, the AQA surfactants herein provide substantial cleaning enhancement with respect to clay soil removal from fabrics, as compared with conventional detergent mixtures. Again, while not intending to be limited by theory, it may be speculated that conventional cationic surfactants associate with the clay in "close-packed" fashion and render the clay more difficult to remove. In contrast, the alkoxylated AQA surfactants are believed to provide more open associations with clays, which are then more readily removed from fabric surfaces. Whatever the reason, the compositions herein containing the AQA surfactants provide improved performance over conventional cationic surfactants with special regard to clay soil removal.

Still further advantages for the AQA surfactants herein have been discovered. For example, in bleaching compositions which comprise a bleach activator (as disclosed herein) it appears that some sort of ion pair or other associative complex is formed with the per-acid released from the activator. It may be speculated that this ion pair is carried more efficiently into the soil as a new, more hydrophobic agent, thereby enhancing bleach performance associated with the use of bleach activators such as nonanoyloxy benzene sulfonate (NOBS). Quite low levels (as low as 3 ppm in the laundering liquor) of AQA surfactants gives rise to these results.

Moreover, in compositions without bleach, the formulator my choose to use somewhat higher levels of AQA to provide enhanced performance benefits. These benefits may be associated with the ability of the AQA surfactants herein to modify the solution characteristics of conventional anionic surfactants such as alkyl sulfates or alkyl benzene sulfonates to allow more of the surfactants to be available to perform their cleaning function. This is particularly true in situations faced by the formulator where the detergent composition is "underbuilt" with respect to calcium and/or magnesium water hardness ions. Under such circumstances, it is preferred to use sufficient AQA surfactant to provide from about 10 ppm to about 50 ppm of the AQA surfactants in the wash liquor. This translates into compositional usage ranges from about 1% to about 5%, by weight, in fully-formulated detergent compositions. (This concentration can vary with product usage rates and the amount of other surfactant present in the wash liquor. For high product concentrations up to about 3500 ppm, the AQA level may be as high as 100–150 ppm in solution. This still only translates to 3–4% AQA surfactant in the finished detergent composition.) It has further been discovered that the AQA surfactants herein containing about 2 ethylene oxide (EO) groups perform extremely well under circumstances of low water hardness or when well-built detergent compositions are used. However, under circumstances of high hardness (about 170 ppm calcium carbonate, and higher) it is more preferred to use AQA surfactants with at least about 3.5 EO groups. Moreover, for some soils and stains, such as fecal matter, AQA surfactants having on the order of 10–20 EO groups are preferred. Accordingly, mixtures of AQA surfactants can be blended and used to provide a broad spectrum of cleaning performance over a wide variety of soils and stains and under a wide range of usage conditions. Representative, but non-limiting, examples of such combinations of AQA surfactants are disclosed in the Examples hereinafter.

Various other advantages of the AQA surfactants over cationic surfactants known in the art are described in more detail hereinafter. As will be seen from the disclosures herein, the AQA surfactants, used in the manner of the present invention, successfully address many of the problems associated with the formulation of modem, high-performance detergent compositions. In particular, the AQA surfactants allow the formulation of effective laundry compositions which can be used to remove a wide variety of soils and stains under a wide spectrum of usage conditions.

These and other advantages of the present invention will be seen from the following disclosures.

BACKGROUND ART

U.S. Pat. No. 5,441,541, issued Aug. 15, 1995, to A. Mehreteab and F. J. Loprest, relates to anionic/cationic surfactant mixtures. U.K. 2,040,990, issued Sep., 3, 1980, to A. P. Murphy, R. J. M. Smith and M. P. Brooks, relates to ethoxylated cationics in laundry detergents.

SUMMARY OF THE INVENTION

The present invention relates to cleaning compositions comprising or prepared by combining an effective amount of certain alkoxylated (especially ethoxylated) quaternary ammonium surfactants and one or more non-AQA surfactants and one or more detersive (including fabric care) adjuncts, as disclosed hereinafter. The alkoxylated quaternary ammonium (AQA) surfactants used in the present invention are of the general formula:

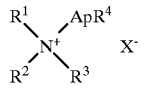

wherein $R^1$ is an alkyl or alkenyl moiety containing from about 8 to about 18 carbon atoms, preferably 10 to about 16 carbon atoms, most preferably from about 10 to about 14 carbon atoms; $R^2$ and $R^3$ are each independently alkyl groups containing from one to about three carbon atoms, preferably methyl; $R^4$ is selected from hydrogen (preferred), methyl and ethyl, $X^-$ is an anion such as chloride, bromide, methylsulfate, sulfate, or the like, to provide electrical neutrality; A is selected from $C_1$–$C_4$ alkoxy, especially ethoxy (i.e., —$CH_2CH_2O$—), propoxy, butoxy and mixtures thereof; and p is from 2 to about 30, preferably 2 to about 15, most preferably 2 to about 8.

AQA compounds wherein the hydrocarbyl substituent $R^1$ is $C_8$–$C_{11}$, especially $C_{10}$, enhance the rate of dissolution of laundry granules, especially under cold water conditions, as compared with the higher chain length materials. Accordingly, the $C_8$–$C_{11}$ AQA surfactants may be preferred by some formulators. The levels of the AQA surfactants used to prepare finished laundry detergent compositions can range from about 0.1% to about 5%, typically from about 0.45% to about 2.5%, by weight.

The present invention encompasses the use of the aforesaid AQA surfactants to enhance the overall cleaning performance of detergent compositions which contain otherwise known ingredients. It has now been discovered that the overall cleaning performance of such detergent compositions can be improved by the incorporation of relatively small quantities of the AQA surfactants. Surprisingly, laundry cleaning performance with respect not only to greasy soils, but also body soil, builder sensitive soil, bleach sensitive soil, as well as food stains and sock soil is enhanced. Of course, the usage levels and mode of use of the AQA surfactants in detergent formulations of various types will depend on the desires of the formulator. Representative, but non-limiting, examples of such formulations include the following.

Detergent compositions which comprise conventional detersive ingredients, an AQA surfactant and a percarbonate bleach.

Detergent compositions which comprise conventional detersive ingredients, an AQA surfactant and a branched-chain surfactant, including branched-chain alkyl sulfate.

Detergent compositions which comprise conventional detersive ingredients, an AQA surfactant and one or more bleach activators.

Detergent compositions which comprise conventional detersive ingredients, an AQA surfactant and a photobleach.

Detergent compositions which comprise conventional detersive ingredients, an AQA surfactant and a layered silicate builder.

Detergent compositions which comprise conventional detersive ingredients, an AQA surfactant and a polyester or oligoester soil release agent.

Detergent compositions which comprise conventional detersive ingredients, an AQA surfactant and a cellulase, amylase or lipase enzyme, or mixtures thereof.

Detergent compositions which comprise conventional detersive ingredients, an AQA surfactant and ethylenediaminedisuccinate chelant.

Detergent compositions which comprise conventional detersive ingredients, an AQA surfactant and an alkyl polyglycoside or polyhydroxy fatty acid amide surfactant.

Detergent compositions which comprise conventional detersive ingredients, an AQA surfactant and a non-aqueous liquid carrier matrix.

Detergent compositions which comprise conventional detersive ingredients, an AQA surfactant and a detergent granule having a bulk density of 650 g/L, or greater.

Detergent compositions which comprise conventional detersive ingredients, an AQA surfactant and a source of magnesium ions, calcium ions, or mixtures thereof.

Detergent compositions which comprise conventional detersive ingredients, an AQA surfactant and a dye-transfer inhibitor.

Detergent compositions which comprise conventional detersive ingredients, an AQA surfactant and a manganese, cobalt or iron bleach catalyst.

Detergent compositions which comprise conventional detersive ingredients, an AQA surfactant and a zeolite P or "MAP" builder.

Detergent compositions which comprise conventional detersive ingredients, an AQA surfactant and a Mineral Builder.

The AQA surfactants used in the manner of the present invention also provide an improved method for removing the following soils and stains from fabrics: blood; greasy food stain; particulate stain; body soils (including fabric "dinginess" caused by small, but noticeable, stain/soil accumulations over time) and other stains noted herein. Such stains and soils are removed from fabrics such as cotton, polyester/cotton blends (P/C) and double-knit polyester (DKPE). The method comprises contacting fabrics in need of removal of such soils with an effective amount of the compositions herein, in the presence of water, and preferably with agitation. Various suitable usage levels and methods are disclosed hereinafter.

With special regard to a fabric laundering context, the AQA compounds herein have the advantage that they are commercially available and are compatible with the various detersive ingredients such as builders, detersive enzymes, and the like, which are used in many modem, high quality, fully-formulated laundry detergents. Moreover, the AQA compounds exhibit satisfactory stability in the presence of the bleach ingredients commonly used in laundry detergent-plus-bleach compositions. Importantly, the AQA surfactants herein exhibit superior performance with respect to the removal of body soils and everyday soils such as sock soil. The combination of the AQA surfactants with the specified anionic surfactants then removes such soils from fabrics. (This effect also makes the AQA surfactants especially useful in hard surface cleaners, where removal of soap "scum" is a desirable product attribute.) In short, the compositions herein provide improved performance for cleaning a broad spectrum of soils and stains including body soils from collars and cuffs, greasy soils, and enzyme/bleach sensitive stains such as spinach and coffee. The compositions herein also provide excellent cleaning on builder sensitive stains such as clay, and thus are especially useful in a nil-P context.

Moreover, the AQA surfactants herein provide improved fabric cleaning performance in the presence of bleach. This improvement in cleaning is seen at usage levels as low as 3 parts per million (ppm) of the AQA in the laundry liquor and is believed to be associated with increased perhydrolysis.

In addition, the AQA surfactants herein provide improved (even synergistic) performance with amylase and cellulase enzymes. This improvement is seen especially in the absence of bleach.

All percentages, ratios and proportions herein are by weight of ingredients used to prepare the finished compositions unless otherwise specified. All documents cited herein are, in relevant part, incorporated herein by reference.

DETAILED DESCRIPTION OF THE INVENTION

In one of its several aspects, this invention provides a means for enhancing the removal of greasy/oily soils by combining a lipase enzyme with an AQA surfactant. Greasy/oily "everyday" soils are a mixture of triglycerides, lipids, complex polysaccharides, inorganic salts and proteinaceous matter. When soiled garments are stored before washing, some triglycerides are converted by bacterial action to fatty acids; lipase enzymes can be used to convert any remaining triglycerides to fatty acids through-the-wash. Generally, for formulas relying on hardness control by diffusion builders (e.g., layered silicates) pseudo unbuilt conditions will be present early a the wash which features a large intake of cold water. In these first minutes, fatty acids in the soil interact with the unbuilt hardness to form insoluble calcium lime-soaps which then hinder subsequent soil removal and cause soil residues to remain on the fabric after the wash. In unbuilt formulations this greasy/oily stain insolubilization will cause even more of a problem. Upon successive wearing/washing, residues build-up, leading to yellowing and entrapment of particulate dirt. Eventually, garments become dingy, are perceived as unwearable and are often discarded.

It has now been found that detergent compositions containing AQA surfactants and lipase enzyme deliver superior cleaning and whiteness performance vs. products containing either technology alone. These benefits appear to be the result of: (1) AQA inhibiting lime soap formation (allowing unhindered lipase access to the soil); and (2) effective lifting off of fatty acids from the soil (by AQA) to ensure maximum lipase activity (high levels of fatty acids in the soil inhibiting lipase action).

This invention also provides improved cleaning and fabric care benefits by combining a cellulytic enzyme with an AQA surfactant. In older/worn cotton fabrics or other cellulosic fabrics the sheathes around individual fibres degrade to form gelatinous/amorphous cellulose "glues" which entrap dirt. In addition, the glue acts as an ideal substrate for deposition/retention of greasy/oily body soils (e.g., on collars and pillowcases) which are a mixture of triglycerides, lipids, complex polysaccharides, inorganic salts and proteinaceous matter. Removal of these hydrophobic soils from worn fabrics is thus very difficult and low levels of residual stain often remain on the fabric after washing. Again, after successive wearing/washing these soils build up, leading to yellowing and more entrapment of dirt.

Surprisingly, it has now been found that detergent compositions containing the AQA surfactants and cellulytic enzymes (e.g., cellulases and/or endoglucanases) deliver superior cleaning and whiteness performance vs. products containing either ingredient alone. These benefits appear to be the result of the effective penetration of hydrophobic body soils by the AQA surfactants. This, in turn, boosts access of the cellulytic enzymes which degrade the amorphous cellulose glue (which binds the soil on the fabric) around the fibers. As the glue dissolves, the entrapped dirt is released and whiteness is restored. In addition to cleaning benefits, the combined cellulytic/AQA system also provides softness benefits vs. the cationic or enzyme alone; effective depilling and ungluing of worn fibers leads to improved fabric softness feel.

As noted, complete removal of the very hydrophobic "everyday" or "body" soils is difficult and low levels of residual soils often remain on the fabric after washing. These residues build up and act like an amorphous glue between the fibers, entrapping particulate dirt and leading to fabric yellowing. It has now further been discovered that detergent compositions containing a combination of the water-soluble AQA surfactants herein and amylase enzymes delivers superior cleaning and whiteness performance vs. compositions containing either technology alone. These benefits appear to be the result of much improved degradation of the residual "glue" around the fibers (AQA facilitating improved amylase access to sensitive soil components through effective soil solubilization). As the glue dissolves, whiteness is restored and entrapped particulate dirt is released/made accessible to the decolorizing action of other wash actives.

This invention also provides detergent compositions which deliver effective cleaning of greasy/oily everyday soils via use of percarbonate bleach with an AQA surfactant as disclosed herein. Percarbonate, which delivers peroxide bleach into the wash, is a cornerstone technology of modern, ultra-compact granular laundry detergent formulas. Peroxide bleach is very hydrophilic and, while it cannot match the bleaching effectiveness delivered by peracids (formed for example from peroxide interaction with TAED), it is effective at decoloration of pigments (e.g., in particulates or beverage stains) and also can help remove the color from the organic residues associated with body soils. Unexpectedly, it has now been discovered that compositions containing AQA surfactants and percarbonate bleach deliver superior cleaning and whiteness performance vs. products containing either technology alone. These benefits appear to be driven by the effective solubilization of the greasy oil soils by AQA, thereby allowing access of the hydrophilic peroxide bleach to the color bodies in the soil (e.g., entrapped pigments) and resulting in improved soil decoloration.

This invention also provides detergent compositions which deliver effective cleaning of greasy/oily everyday soils by means of hydrophobic bleach activators used in combination with a water-soluble AQA surfactant of the present type. Everyday soil cleaning and whiteness benefits for hydrophobic bleach activators and peracids have already been demonstrated. Such materials are, to a limited degree, able to penetrate complex/greasy oily soils. It has now been found that detergent and bleach compositions containing AQA and hydrophobic bleach activators (including preformed peracids) deliver superior cleaning and whiteness performance vs. similar compositions containing either technology alone. It may be reasonably speculated that the benefits for the combined system are driven by: (1) AQA action on the soil surface to prevent lime soap formation and to lift off any calcium soaps present, thereby boosting hydrophobic bleach access; (2) The significantly lower surface tension at the soil/wash liquor interface (driven by AQA). As surface tension falls the hydrophobic bleach (which acts like anionic surfactant) soil penetration is boosted; and (3) Possible interaction of the hydrophobic peracid with the AQA to form a very hydrophobic ion pair, which easily penetrates deep into the greasy soil.

This invention also provides compositions which deliver effective cleaning of greasy/oily soils via use of bleach catalysts using an AQA surfactant. Bleach catalysts (characterized by the presence of at least one transition metal atom) interact with peroxide to form very powerful hydrophilic bleaches. These bleaches deliver strong benefits on colored hydrophilic stains and hydrophilic everyday soils (i.e., socks). The catalysts are typically used at extremely low levels in cleaning products. As disclosed herein, products containing AQA and catalysts deliver superior cleaning and whiteness performance vs. products containing either technology alone, and are especially potent on everyday soils. These benefits are believed to be driven by effective AQA solubilization on the greasy oil soils which allow access of the hydrophilic "catalyst" bleach to the color bodies in the soil, thereby leading to effective soil decolorization. Furthermore, historical use of bleach catalysts was made difficult because of concerns about fabric damage. Using a dimanganese catalyst, known to cause fabric damage, it has now been found that the occurrence of fabric damage is much reduced when AQA cationics are present. Presumably, these cationics adsorb onto fabrics where they modify the surface charge and are available to ion-pair with the activated catalyst to minimize or prevent fabric damage.

In another aspect, this invention allows the use of high levels of insoluble inorganic builders, without fabric encrustation, using layered silicates with a water-soluble AQA surfactant. Layered silicates are composed of discreet units some faces of which are negatively charged. It may be speculated that the positively charged head-group of AQA interacts, via electrostatic bond formation, with the negatively charged face to form a surfactant monolayer upon which a second "hydrophilic" surfactant layer builds up. This drives particle lift-off from fabrics, thereby minimizing encrustation which can otherwise result in a harsh "feel to the fabrics".

This invention also allows the formulation of high levels of insoluble inorganic or soluble (bi)carbonate builders in compositions containing relatively low polycarboxylate polymers, without driving fabric encrustation issues by using the different types of builder with an AQA surfactant as disclosed herein. Historically, high molecular weight polycarboxylate polymers have been used as dispersants in granular laundry detergents. These polymers are, however, generally expensive. The polymers, as well as being effective at soil suspension, also effectively control fabric encrustation by lifting off inorganics (including builders/precipitated carbonates) from fabrics. Low polymer formulations known heretofore are prone to fabric encrustation shortcomings.

It has now been found that high levels of inorganic and/or (bi)carbonate builders can be used in combination with low levels of polymers and/or lower molecular weight polymers without increasing fabric encrustation by use of the AQA surfactants in the manner disclosed herein. Fabric encrustation problems are believed to be avoided for the low polymer system by two AQA mechanisms: (1) layered silicates and zeolites are composed of discreet units, some faces of which will be negatively charged. AQA, which has a positively charged headgroup, may interact with these faces to lift off the inorganics from fabrics by formation of hydrophilic, charged surfactant bilayers around the inorganic particles; and/or (2) AQA is more fabric substantive vs. anionic/nonionic surfactants. Accordingly, low levels of these materials adsorb onto fabric surfaces where they modify surface charge. Since the degree of carbonate encrustation is dependent on negative surface charge, the AQA adsorption (which modifies the cotton surface charge to neutral/positive) allows less encrustation to occur. In addition, AQA can adsorb onto the "growing" faces of calcium carbonate crystals, thereby inhibiting crystal growth and minimizing encrustation on fabrics.

This invention also provides detergent compositions which deliver effective cleaning of greasy/oily "everyday" soils (and accidental soils), via use of polyethoxyated-polyamine polymers (PPP) with the AQA surfactants herein. As noted, greasy/oily "everyday" soils (e.g., on collars, pillowcases) are a mixture of triglycerides, lipids, complex polysaccharides, inorganic salts and proteinaceous matter. Complete removal of these very hydrophobic soils is difficult and low levels of residual stain often remain on the fabric after washing. To improve performance in this key area, various soil dispersant polymers have been developed. Characteristic features of these materials include: (1) a reasonably low molecular weight "hydrophobic" polyamine backbone (which is slightly cationic in nature providing an affinity for soils and fabrics); and (2) pendant "hydrophilic" polyethoxylate groups which provide steric stabilization and greasy soil suspension. During the wash, these polymers work at the stain/wash liquor interface.

Surprisingly, it has now been discovered that detergent compositions containing the AQA surfactants herein and ethoxylated polyamine polymers deliver superior cleaning and whiteness performance vs. compositions containing either technology alone. Benefits for the mixed system are believed to be the result of: (1) AQA action on the stain surface to prevent lime soap formation and to lift off any calcium soaps present, thereby facilitating improved polymer deposition; (2) AQA providing solubilization deep into the soil, while the polymer acts as a "grease removal shuttle", stripping out the AQA-solubilized stain components and dispersing them into the wash liquor.

This invention also provides detergent compositions which deliver effective cleaning of greasy/oily everyday soils, by means of use of high levels of surfactant (optionally including branched surfactants) with an AQA surfactant. In view of the importance of high surfactancy in the effective removal of greasy/oily body soil, modem "ultra-compact" detergent compositions generally contain high levels of surfactants (nonionic and anionic) and are fairly effective at body soil cleaning. Unexpectedly, it has now been found that products containing AQA and high levels of anionic or mixed anionic/nonionic surfactants (optionally including branched surfactants) deliver superior cleaning performance vs. products containing either technology alone. These benefits are driven by: (1) AQA action on the soil surface to prevent lime soap formation and lift off any calcium soaps present (these soaps, if allowed to form and left at the soil-wash liquor interface, would largely prevent surfactant access); (2) AQA lowering of the surface tension between the wash liquor and the greasy/oily soil, thereby driving more effective soil penetration by surfactant (hence boosting cleaning); and (3) Possible ion pair formation between the cationic and anionic surfactant to form a very hydrophobic surfactant "pair" molecule which penetrates deep into the greasy soil.

In addition, this invention provides detergent, bleach and other compositions which deliver improved perfume residuality on fabrics after the wash, via use of perfume with a water-soluble AQA surfactant. Natural and synthetic fabrics can be characterized by the surface charge on their fibers. Cotton is hydrophilic with a net negative surface charge, whereas polyester is hydrophobic with a neutral surface charge. Perfumes are a complex mixture of hydrophobic organic actives, including esters, alcohols, ketones, aldehydes, ethers, and the like. The fabric substantivity of different perfume actives depends on: (1) functionality (how polar they are); (2) the molecular weight of the active; and (3) the charge on the fabric fibers. Most perfume actives contain electron-rich oxygen atoms which will be attracted to electron deficient molecules/surfaces.

Unexpectedly, it has now been found that the combination of AQA surfactants with perfumes (characterized as having >10% of components with molecular weight >150) provides improved perfume fabric substantivity. While not intending to be limited by theory, it appears that, as well as increasing the hydrophobicity of anionic or anionic/nonionic surfactant systems, the AQA surfactants have high fabric substantivity (especially for cotton). The AQA surfactants appear to adsorb onto the fibers where they change the surface charge from neutral/negative to positive (or electron deficient). This modified fabric surface acts like a magnet to the electron rich domains of the perfume actives, thereby drawing them onto the fabrics where they are held electrostatically. This significantly increases perfume residuality. These benefits are most pronounced for perfume components having at least one oxygen atom and a molecular weight greater than 150. The level of such perfume ingredients should account for at least about 10% of the total perfume mixture to achieve the maximum benefit of this effect.

The present invention employs an "effective amount" of the AQA surfactants to improve the performance of cleaning compositions which contain other adjunct ingredients. By an "effective amount" of the AQA surfactants and adjunct ingredients herein is meant an amount which is sufficient to improve, either directionally or significantly at the 90% confidence level, the performance of the cleaning composition against at least some of the target soils and stains. Thus, in a composition whose targets include certain food stains, the formulator will use sufficient AQA to at least directionally improve cleaning performance against such stains. Likewise, in a composition whose targets include clay soil, the formulator will use sufficient AQA to at least directionally improve cleaning performance against such soil. Importantly, in a fully-formulated laundry detergent the AQA surfactants can be used at levels which provide at least a directional improvement in cleaning performance over a wide variety of soils and stains, as will be seen from the data presented hereinafter.

As noted, the AQA surfactants are used herein in detergent compositions in combination with other detersive surfactants at levels which are effective for achieving at least a directional improvement in cleaning performance. In the context of a fabric laundry composition, such "usage levels" can vary depending not only on the type and severity of the soils and stains, but also on the wash water temperature, the volume of wash water and the type of washing machine.

For example, in a top-loading, vertical axis U.S.-type automatic washing machine using about 45 to 83 liters of water in the wash bath, a wash cycle of about 10 to about 14 minutes and a wash water temperature of about 10° C. to about 50° C., it is preferred to include from about 2 ppm to about 50 ppm, preferably from about 5 ppm to about 25 ppm, of the AQA surfactant in the wash liquor. On the basis of usage rates of from about 50 ml to about 150 ml per wash load, this translates into an in-product concentration (wt.) of the AQA surfactant of from about 0.1% to about 3.2%, preferably about 0.3% to about 1.5%, for a heavy-duty liquid laundry detergent. On the basis of usage rates of from about 60 g to about 95 g per wash load, for dense ("compact") granular laundry detergents (density above about 650 g/l) this translates into an in-product concentration (wt.) of the AQA surfactant of from about 0.2% to about 5.0%, preferably from about 0.5% to about 2.5%. On the basis of usage rates of from about 80 g to about 100 g per load for spray-dried granules (i.e., "fluffy"; density below about 650 g/l), this translates into an in-product concentration (wt.) of the AQA surfactant of from about 0.1% to about 3.5%, preferably from about 0.3% to about 1.5%.

For example, in a front-loading, horizontal-axis European-type automatic washing machine using about 8 to 15 liters of water in the wash bath, a wash cycle of about 10 to about 60 minutes and a wash water temperature of about 30° C. to about 95° C., it is preferred to include from about 13 ppm to about 900 ppm, preferably from about 16 ppm to about 390 ppm, of the AQA surfactant in the wash liquor. On the basis of usage rates of from about 45 ml to about 270 ml per wash load, this translates into an in-product concentration (wt.) of the AQA surfactant of from about 0.4% to about 2.64%, preferably about 0.55% to about 1.1%, for a heavy-duty liquid laundry detergent. On the basis of usage rates of from about 40 g to about 210 g per wash load, for dense ("compact") granular laundry detergents (density above about 650 g/l) this translates into an in-product concentration (wt.) of the AQA surfactant of from about 0.5% to about 3.5%, preferably from about 0.7% to about 1.5%. On the basis of usage rates of from about 140 g to about 400 g per load for spray-dried granules (i.e., "fluffy"; density below about 650 g/l), this translates into an in-product concentration (wt.) of the AQA surfactant of from about 0.13% to about 1.8%, preferably from about 0.18% to about 0.76%.

For example, in a top-loading, vertical-axis Japanese-type automatic washing machine using about 26 to 52 liters of water in the wash bath, a wash cycle of about 8 to about 15 minutes and a wash water temperature of about 5° C. to about 25° C., it is preferred to include from about 1.67 ppm to about 66.67 ppm, preferably from about 3 ppm to about 6 ppm, of the AQA surfactant in the wash liquor. On the basis of usage rates of from about 20 ml to about 30 ml per wash load, this translates into an in-product concentration (wt.) of the AQA surfactant of from about 0.25% to about 10%, preferably about 1.5% to about 2%, for a heavy-duty liquid laundry detergent. On the basis of usage rates of from about 18 g to about 35 g per wash load, for dense ("compact") granular laundry detergents (density above about 650 g/l) this translates into an in-product concentration (wt.) of the AQA surfactant of from about 0.25% to about 10%, preferably from about 0.5% to about 1.0%. On the basis of usage rates of from about 30 g to about 40 g per load for spray-dried granules (i.e., "fluffy"; density below about 650 g/l), this translates into an in-product concentration (wt.) of the AQA surfactant of from about 0.25% to about 10%, preferably from about 0.5% to about 1%.

As can be seen from the foregoing, the amount of AQA surfactant used in a machine-wash laundering context can vary, depending on the habits and practices of the user, the type of washing machine, and the like. In this context, however, one heretofore unappreciated advantage of the AQA surfactants is their ability to provide at least directional improvements in performance over a spectrum of soils and stains even when used at relatively low levels with respect to the other surfactants (generally anionics or anionic/nonionic mixtures) in the finished compositions. This is to be distinguished from other compositions of the art wherein various cationic surfactants are used with anionic surfactants at or near stoichiometric levels. In general, in the practice of this invention, the weight ratio of AQA:anionic surfactant in laundry compositions is in the range from about 1:70 to about 1:2, preferably from about 1:40 to about 1:6. In laundry compositions which comprise both anionic and nonionic surfactants, the weight ratio of AQA:mixed anionic/nonionic is in the range from about 1:80 to 1:2, preferably about 1:50 to about 1:8.

Various other cleaning compositions which comprise an anionic surfactant, an optional nonionic surfactant and specialized surfactants such as betaines, sultaines, amine oxides, and the like, can also be formulated using an effective amount of the AQA surfactants in the manner of this invention. Such compositions include, but are not limited to, hand dishwashing products (especially liquids or gels), hard surface cleaners, shampoos, personal cleansing bars, and the like. Since the habits and practices of the users of such compositions show minimal variation, it is satisfactory to include from about 0.25% to about 5%, preferably from about 0.45% to about 2%, by weight, of the AQA surfactants in such compositions. Again, as in the case of the granular and liquid laundry compositions, the weight ratio of the AQA surfactant to other surfactants present in such compositions is low, i.e., sub-stoichiometric in the case of anionics. Preferably, such cleaning compositions comprise AQA/surfactant ratios as noted immediately above for machine-use laundry compositions.

In contrast with other cationic surfactants known in the art, the alkoxylated cationics herein have sufficient solubility that they can be used in combination with mixed surfactant systems which are quite low in nonionic surfactants and which contain, for example, alkyl sulfate surfactants. This can be an important consideration for formulators of detergent compositions of the type which are conventionally designed for use in top loading automatic washing machines, especially of the type used in North America as well as under Japanese usage conditions. Typically, such compositions will comprise an anionic surfactant:nonionic surfactant weight ratio in the range from about 25:1 to about 1:25, preferably about 20:1 to about 3:1. This can be contrasted with European-type formulas which typically will comprise anionic:nonionic ratios in the range of about 10:1 to 1:10, preferably about 5:1 to about 1:1.

The preferred ethoxylated cationic surfactants herein can be synthesized using a variety of different reaction schemes (wherein "EO" represents —$CH_2CH_2O$—units), as follows.

SCHEME 1

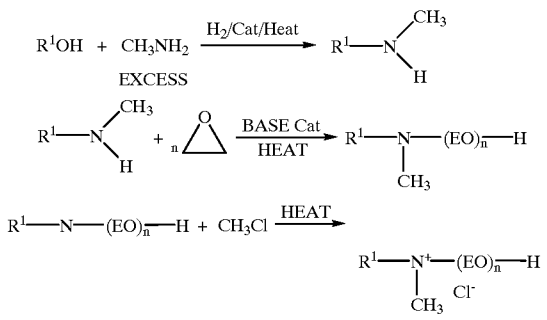

SCHEME 2

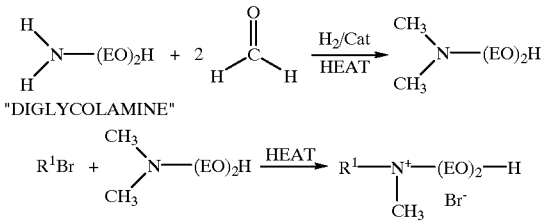

SCHEME 3

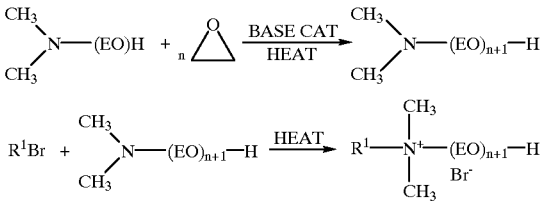

SCHEME 4

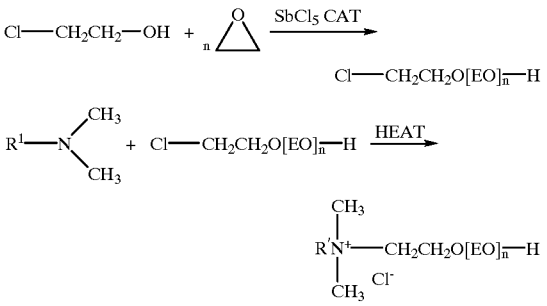

An economical reaction scheme is as follows.

SCHEME 5

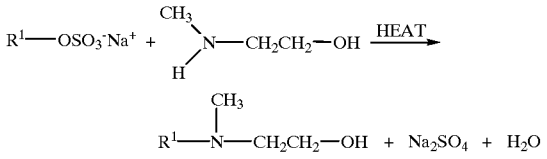

-continued

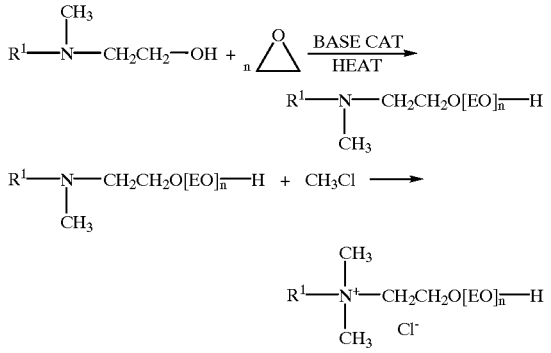

For reaction Scheme 5, the following parameters summarize the optional and preferred reaction conditions herein for step 1. Step 1 of the reaction is preferably conducted in an aqueous medium. Reaction temperatures are typically in the range of 100–230° C. Reaction pressures are 50–1000 psig. A base, preferably sodium hydroxide, can be used to react with the HSO4- generated during the reaction. In another mode, an excess of the amine can be employed to also react with the acid. The mole ratio of amine to alkyl sulfate is typically from 10:1 to 1:1.5; preferably from 5:1 to 1:1.1; more preferably from 2:1 to 1:1. In the product recovery step, the desired substituted amine is simply allowed to separate as a distinct phase from the aqueous reaction medium in which it is insoluble. The product of step 1 is then ethoxylated and quaternized using standard reactions, as shown.

The following illustrates the foregoing for the convenience of the formulator, but is not intended to be limiting thereof.

Preparation of N-(2-hydroxyethyl)-N-methyldodecylamine—To a glass autoclave liner is added 156.15 g of sodium dodecyl sulfate (0.5415 moles), 81.34 g of 2-(methylamino)ethanol (1.083 moles), 324.5 g of distilled $H_2O$, and 44.3 g of 50 wt. % sodium hydroxide solution (0.5538 moles NaOH). The glass liner is sealed into 3 L, stainless steel, rocking autoclave, purged twice with 260 psig nitrogen and then heated to 160–180° C. under 700–800 psig nitrogen for 3 hours. The mixture is cooled to room temperature and the liquid contents of the glass liner are poured into a 1 L separatory funnel. The mixture is separated into a clear lower layer, turbid middle layer and clear upper layer. The clear upper layer is isolated and placed under full vacuum (<100 mm Hg) at 60–65° C. with mixing to remove any residual water. The clear liquid turns cloudy upon removing residual water as additional salts crystallizes out. The liquid is vacuum filtered to remove salts to again obtain a clear, colorless liquid. After a few days at room temperature, additional salts crystallize and settle out. The liquid is vacuum filtered to remove solids and again a clear, colorless liquid is obtained which remains stable. The isolated clear, colorless liquid is the title product by NMR analysis and is >90% by GC analysis with a typical recovery of >90%. The amine is then ethoxylated in standard fashion. Quaternization with an alkyl halide to form the AQA surfactants herein is routine.

According to the foregoing, the following are nonlimiting, specific illustrations of AQA surfactants used herein. It is to be understood that the degree of alkoxylation noted herein for the AQA surfactants is reported as an average, following common practice for conventional ethoxylated nonionic surfactants. This is because the ethoxylation reactions typically yield mixtures of materials with differing degrees of ethoxylation. Thus, it is not uncommon to report total EO values other than as whole numbers, e.g., "EO2.5", "EO3.5", and the like.

| Designation | $R^1$ | $R^2$ | $R^3$ | Alkoxylation |
|---|---|---|---|---|
| AQA-1 | $C_{12}$–$C_{14}$ | $CH_3$ | $CH_3$ | EO2 |
| AQA-2 | $C_{10}$–$C_{16}$ | $CH_3$ | $CH_3$ | EO2 |
| AQA-3 | $C_{12}$ | $CH_3$ | $CH_3$ | EO2 |
| AQA-4 | $C_{14}$ | $CH_3$ | $CH_3$ | EO2-3 |
| AQA-5 | $C_{10}$–$C_{18}$ | $CH_3$ | $CH_3$ | EO5-8 |
| AQA-6 | $C_{12}$–$C_{14}$ | $C_2H_5$ | $CH_3$ | EO3-5 |
| AQA-7 | $C_{14}$–$C_{16}$ | $CH_3$ | $C_3H_7$ | (EO/PrO)4 |
| AQA-8 | $C_{12}$–$C_{14}$ | $CH_3$ | $CH_3$ | (PrO)3 |
| AQA-9 | $C_{12}$–$C_{18}$ | $CH_3$ | $CH_3$ | EO10 |
| AQA-10 | $C_8$–$C_{18}$ | $CH_3$ | $CH_3$ | EO15 |
| AQA-11 | $C_{10}$ | $C_2H_5$ | $C_2H_5$ | EO3.5 |
| AQA-12 | $C_{10}$ | $CH_3$ | $CH_3$ | EO2.5 |
| AQA-13 | $C_{10}$ | $CH_3$ | $CH_3$ | EO3.5 |
| AQA-14 | $C_{10}$ | $C_4H_9$ | $C_4H_9$ | EO30 |
| AQA-15 | $C_8C_{14}$ | $CH_3$ | $CH_3$ | EO2 |
| AQA-16 | $C_{10}$ | $CH_3$ | $CH_3$ | EO10 |
| AQA-17 | $C_{12}$–$C_{18}$ | $C_3H_9$ | $C_3H_7$ | Bu4 |
| AQA-18 | $C_{12}$–$C_{18}$ | $CH_3$ | $CH_3$ | EO5 |
| AQA-19 | $C_8$ | $CH_3$ | $CH_3$ | iPr3 |
| AQA-20 | $C_8$ | $CH_3$ | $CH_3$ | EO3-7 |
| AQA-21 | $C_{12}$ | $CH_3$ | $CH_3$ | EO3.5 |
| AQA-22 | $C_{12}$ | $CH_3$ | $CH_3$ | EO4.5 |

Highly preferred AQA compound for use herein are of the formula

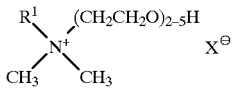

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

Detersive Surfactants—Nonlimiting examples of anionic surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula CH3 $(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alpha-sulfonated fatty acid esters, the $C_{10}$–$C_{18}$ sulfated alkyl polyglycosides, the $C_{10}$–$C_{18}$ alkyl alkoxy sulfates ("$AE_xS$"; especially EO 1–7 ethoxy sulfates), and $C_{10}$–$C_{18}$ alkyl alkoxy carboxylates (especially the EO 1–5 ethoxycarboxylates). The $C_{12}$–$C_{18}$ betaines and sulfobetaines ("sultaines"), $C_{10}$–$C_{18}$ amine oxides, and the like, can also be included in the overall compositions. $C_{10}$–$C_{20}$ conventional soaps may also be used. If high sudsing is desired, the branched-chain $C_{10}$–$C_{16}$ soaps may be used. Other conventional useful surfactants are listed in standard texts.

Nonionic Surfactants—Nonlimiting examples of nonionic surfactants useful herein typically at levels from about 1% to about 55%, by weight include the alkoxylated alcohols (AE's) and alkyl phenols, polyhydroxy fatty acid amides (PFAA's), alkyl polyglycosides (APG's), $C_{10}$–$C_{18}$ glycerol ethers, and the like.

More specifically, the condensation products of primary and secondary aliphatic alcohols with from about 1 to about 25 moles of ethylene oxide (AE) are suitable for use as the nonionic surfactant in the present invention. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 10 to about 18 carbon atoms, with from about 1 to about 10 moles, preferably 2 to 7, most preferably 2 to 5, of ethylene oxide per mole of alcohol. Examples of commercially available nonionic surfactants of this type include: Tergitol™ 15-S-9 (the condensation product of $C_{11}$ –$C_{15}$ linear alcohol with 9 moles ethylene oxide) and Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-3(the condensation product of $C_{12}$–$C_{13}$ linear alcohol with 3 moles of ethylene oxide), Neodol™ 45-7 (the condensation product of $C_{14}$–$C_{15}$ linear alcohol with 7 moles of ethylene oxide) and Neodol™ 45-5(the condensation product of $C_{14}$–$C_{15}$ linear alcohol with 5 moles of ethylene oxide) marketed by Shell Chemical Company; Kyro™ EOB (the condensation product of $C_{13}$–$C_{15}$ alcohol with 9 moles ethylene oxide), marketed by The Procter & Gamble Company; and Genapol LA O3O or O5O (the condensation product of $C_{12}$–$C_{14}$ alcohol with 3 or 5 moles of ethylene oxide) marketed by Hoechst. The preferred range of HLB in these AE nonionic surfactants is from 8–11 and most preferred from 8–10. Condensates with propylene oxide and butylene oxides may also be used.

Another class of preferred nonionic surfactants for use herein are the

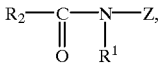

wherein $R^1$ is H, or $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or $C_{15-17}$ alkyl or alkenyl chain such as coconut alkyl or mixtures thereof, and Z is derived from a reducing sugar such as glucose, fructose, maltose, lactose, in a reductive amination reaction. Typical examples include the $C_{12}$–$C_{18}$ and $C_{12}$–$C_{14}$ N-methylglucamides. See U.S. Pat. Nos. 5,194,639 and 5,298,636. N-alkoxy polyhydroxy fatty acid amides can also be used; see U.S. Pat. No. 5,489,393.

Also useful as the nonionic surfactant in the present invention are the alkylpolysaccharides such as those disclosed in U.S. Pat. No. 4,565,647, Llenado, issued Jan. 21, 1986, having a hydrophobic group containing from about 6 to about 30 carbon atoms, preferably from about 10 to about 16 carbon atoms, and a polysaccharide, e.g. a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6- positions on the preceding saccharide units. The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

Polyethylene, polypropylene, and polybutylene oxide condensates of alkyl phenols are also suitable for use as the nonionic surfactant of the surfactant systems of the present invention, with the polyethylene oxide condensates being preferred. These compounds include the condensation products of alkyl phenols having an alkyl group containing from about 6 to about 14 carbon atoms, preferably from about 8 to about 14 carbon atoms, in either a straight-chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of ethylene oxide with a hydrophobic base formed by the condensation of propylene oxide with propylene glycol are also suitable for use as the additional nonionic surfactant in the present invention. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

Also suitable for use as the nonionic surfactant of the nonionic surfactant system of the present invention, are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

The following illustrates various other adjunct ingredients which may be used in the compositions of this invention, but is not intended to be limiting thereof. While the combination of the AQA and the anionic surfactants with such adjunct compositional ingredients can be provided as finished products in the form of liquids, gels, bars, or the like using conventional techniques, the manufacture of the granular laundry detergents herein requires some special processing techniques in order to achieve optimal performance. Accordingly, the manufacture of laundry granules will be described hereinafter separately in the Granules Manufacture section (below), for the convenience of the formulator.

Builders—Detergent builders can optionally but preferably be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain detergent additive or high-surfactant formulations can be unbuilt.

Suitable builders herein can be selected from the group consisting of phosphates and polyphosphates, especially the sodium salts; silicates including water-soluble and hydrous solid types and including those having chain-, layer-, or three-dimensional-structure as well as amorphous-solid or non-structured-liquid types; carbonates, bicarbonates, sesquicarbonates and carbonate minerals other than sodium carbonate or sesquicarbonate; aluminosilicates; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0:1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable silicate builders include alkali metal silicates, particularly those liquids and solids having a $SiO_2$:$Na_2O$ ratio in the range 1.6:1 to 3.2:1, including, particularly for automatic dishwashing purposes, solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminium-free δ—$Na_2SiO_5$ morphology silicate marketed by Hoechst and is preferred especially in granular laundry compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the α, β and γ layer-silicate forms. Other silicates may also be useful, such as magnesium silicate, which can serve as a crispening agent in granules, as a stabilising agent for bleaches, and as a component of suds control systems.

Also suitable for use herein are synthesized crystalline ion exchange materials or hydrates thereof having chain structure and a composition represented by the following general formula in an anhydride form: $xM_2O.ySiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds.

Aluminosilicate builders are especially useful in granular detergents, but can also be incorporated in liquids, pastes or gels. Suitable for the present purposes are those having empirical formula: $[M_z(AlO_2)_z(SiO2)_v].xH_2O$ wherein z and v are integers of at least 6, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Suitable organic detergent builders include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable builders are the ether hydroxypolycarboxylates, copolymers of maleic anhydride with ethylene or vinyl methyl ether; 1, 3, 5-trihydroxy benzene-2, 4, 6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3, 5-tricarboxylic acid, carboxymethyloxysuccinic acid, and soluble salts thereof.

Citrates, e.g., citric acid and soluble salts thereof are important carboxylate builders e.g., for heavy duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, alkali metal phosphates, such as sodium tripolyphosphates, sodium pyrophosphate and sodium orthophosphate, can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologs also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$–$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Laurylsuccinates are described in European Patent Application 86200690.5/0,200,263, published Nov. 5, 1986. Fatty acids, e.g., $C_{12}$–$C_{18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl, U.S. Pat. No. 3,723,322.

Other types of inorganic builder materials which can be used have the formula $(M_x)_i\ Ca_y\ (CO_3)_z$ wherein x and i are integers from 1 to 15, y is an integer from 1 to 10, z is an integer from 2 to 25, $M_i$ are cations, at least one of which is a water-soluble, and the equation $\Sigma_{i=1-15}(x_i$ multiplied by the valence of $M_i)+2y=2z$ is satisfied such that the formula has a neutral or "balanced" charge. These builders are referred to herein as "Mineral Builders". Waters of hydration or anions other than carbonate may be added provided that the overall charge is balanced or neutral. The charge or valence effects of such anions should be added to the right side of the above equation. Preferably, there is present a water-soluble cation selected from the group consisting of hydrogen, water-soluble metals, hydrogen, boron, ammonium, silicon, and mixtures thereof, more preferably, sodium, potassium, hydrogen, lithium, ammonium and mixtures thereof, sodium and potassium being highly preferred. Nonlimiting examples of noncarbonate anions include those selected from the group consisting of chloride, sulfate, fluoride, oxygen, hydroxide, silicon dioxide, chromate, nitrate, borate and mixtures thereof. Preferred builders of this type in their simplest forms are selected from the group consisting of $Na_2Ca(CO_3)_2$, $K_2Ca(CO_3)_2$, $Na_2Ca_2(CO_3)_3$, $NaKCa(CO_3)_2$, $NaKCa_2(CO_3)_3$, $K_2Ca_2(CO_3)_3$, and combinations thereof. An especially preferred material for the builder described herein is $Na_2Ca(CO_3)_2$ in any of its crystalline modifications. Suitable builders of the above-defined type are further illustrated by, and include, the natural or synthetic forms of any one or combinations of the following minerals: Afghanite, Andersonite, AshcroftineY, Beyerite, Borcarite, Burbankite, Butschliite, Cancrinite, Carbocemaite, Carletonite, Davyne, DonnayiteY, Fairchildite, Ferrisurite, Franzinite, Gaudefroyite, Gaylussite, Girvasite, Gregoryite, Jouravskite, KamphaugiteY, Kettnerite, Khanneshite, LepersonniteGd, Liottite, MckelveyiteY, Microsommite, Mroseite, Natrofairchildite, Nyerereite, RemonditeCe, Sacrofanite, Schrockingerite, Shortite, Surite, Tunisite, Tuscanite, Tyrolite, Vishnevite, and Zemkorite. Preferred mineral forms include Nyererite, Fairchildite and Shortite.

Enzymes—Enzymes can be included in the present detergent compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, cellulases, peroxidases, and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents, such as in automatic dishwashing, it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble . When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein, especially for, but not limited to automatic dishwashing purposes, include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. lichenifonnis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Other amylase enzymes include those described in WO 95/26397 and in co-pending application by Novo Nordisk PCT/DK96/00056. Specific amylase enzymes for use in the detergent compositions of the present invention include α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. (Such Phadebas® α-amylase activity assay is described at pages 9–10, WO 95/26397.) Also included herein are α-amylases which are at least 80% homologous with the amino acid sequences shown in the SEQ ID listings in the references. These enzymes are preferably incorporated into laundry detergent compositions at a level from 0.00018% to 0.060% pure enzyme by weight of the total composition, more preferably from 0.00024% to 0.048% pure enzyme by weight of the total composition.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from *Humicola insolens* or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. lipolyticum NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

In spite of the large number of publications on lipase enzymes, only the lipase derived from *Humicola lanuginosa* and produced in *Aspergillus oryzae* as host has so far found widespread application as additive for fabric washing products. It is available from Novo Nordisk under the tradename Lipolase™, as noted above. In order to optimize the stain removal performance of Lipolase, Novo Nordisk have made a number of variants. As described in WO 92/05249, the D96L variant of the native *Humicola lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100- mg (5–500,000 LU/liter) lipase variant per liter of wash liquor. The present invention provides the benefit of improved whiteness maintenance on fabrics using low levels of D96L variant in detergent compositions containing the AQA surfactants in the manner disclosed herein, especially when the D96L is used at levels in the range of about 50 LU to about 8500 LU per liter of wash solution.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromoperoxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilised by various techniques. Enzyme stabilisation techniques are disclosed and exemplified in U.S. Pat. No. 3,600,319, Aug. 17, 1971, Gedge et al, EP 199,405 and EP 200,586, Oct. 29, 1986, Venegas. Enzyme stabilisation systems are also described, for example, in U.S. Pat. No. 3,519,570. A useful Bacillus, sp. AC13 giving proteases, xylanases and cellulases, is described in WO 9401532 A to Novo.

Enzyme Stabilizing System—The enzyme-containing compositions herein may optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions, for example automatic dishwashing compositions, may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during dish- or fabric-washing, can be relatively large; accordingly, enzyme stability to chlorine in-use is sometimes problematic. Since perborate or percarbonate, which have the ability to react with chlorine bleach, may present in certain of the instant compositions in amounts accounted for separately from the stabilizing system, the use of additional stabilizers against chlorine, may, most generally, not be essential, though improved results may be obtainable from their use. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, (e.g., hydrogen peroxide sources), there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Polymeric Soil Release Agent—Known polymeric soil release agents, hereinafter "SRA" or "SRA's", can optionally be employed in the present detergent compositions. If utilized, SRA's will generally comprise from 0.01% to 10.0%, typically from 0.1% to 5%, preferably from 0.2% to 3.0% by weight, of the composition.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles thereby serving as an anchor for the hydrophilic segments. This can enable stains occurring subsequent to treatment with SRA to be more easily cleaned in later washing procedures.

SRA's can include a variety of charged, e.g., anionic or even cationic (see U.S. Pat. No. 4,956,447), as well as noncharged monomer units and structures may be linear, branched or even star-shaped. They may include capping moieties which are especially effective in controlling molecular weight or altering the physical or surface-active properties. Structures and charge distributions may be tailored for application to different fiber or textile types and for varied detergent or detergent additive products.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without of course forming a densely crosslinked overall structure.

Suitable SRA's include: a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink: such ester oligomers can be prepared by (a) ethoxylating allyl alcohol, (b) reacting the product of (a) with dimethyl terephthalate ("DMT") and 1,2-propylene glycol ("PG") in a two-stage transesterification/ oligomerization procedure and (c) reacting the product of (b) with sodium metabisulfite in water; the nonionic end-capped 1,2-propylene/polyoxyethylene terephthalate polyesters of U.S. Pat. No. 4,711,730, Dec. 8, 1987 to Gosselink et al, for example those produced by transesterification/oligomerization of poly(ethyleneglycol) methyl ether, DMT, PG and poly(ethyleneglycol) ("PEG"); the partly- and fully- anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, Me-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al, the latter being typical of SRA's useful in both laundry and fabric conditioning products, an example being an ester composition made from m-sulfobenzoic acid monosodium salt, PG and DMT optionally but preferably further comprising added PEG, e.g., PEG 3400.

SRA's also include simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; and the $C_1$–$C_4$ alkylcelluloses and $C_4$ hydroxyalkyl celluloses; see U.S. Pat. No. 4,000,093, Dec. 28, 1976 to Nicol, et al. Suitable SRA's characterised by poly(vinyl ester) hydrophobe segments include graft copolymers of poly(vinyl ester), e.g., $C_1$–$C_6$ vinyl esters, preferably poly(vinyl acetate), grafted onto polyalkylene oxide backbones. See European Patent Application 0 219 048, published Apr. 22, 1987 by Kud, et al. Commercially available examples include SOKALAN SRA's such as SOKALAN HP-22, available from BASF, Germany. Other SRA's are polyesters with repeat units containing 10–15% by weight of ethylene terephthalate together with 90–80% by weight of polyoxyethylene terephthalate, derived from a polyoxyethylene glycol of average molecular weight 300–5,000. Commercial examples include ZELCON 5126 from Dupont and MILEASE T from ICI.

Another preferred SRA is an oligomer having empirical formula $(CAP)_2(EG/PG)_5(T)_5(SIP)_1$ which comprises terephthaloyl (T), sulfoisophthaloyl (SIP), oxyethyleneoxy and oxy-1,2-propylene (EG/PG) units and which is preferably terminated with end-caps (CAP), preferably modified isethionates, as in an oligomer comprising one sulfoisophthaloyl unit, 5 terephthaloyl units, oxyethyleneoxy and oxy-1,2-propyleneoxy units in a defined ratio, preferably about 0.5:1 to about 10:1, and two end-cap units derived from sodium 2-(2-hydroxyethoxy)-ethanesulfonate. Said SRA preferably further comprises from 0.5% to 20%, by weight of the oligomer, of a crystallinity-reducing stabiliser, for example an anionic surfactant such as linear sodium dodecylbenzenesulfonate or a member selected from xylene-, cumene-, and toluene- sulfonates or mixtures thereof, these stabilizers or modifiers being introduced into the synthesis pot, all as taught in U.S. Pat. No. 5,415,807, Gosselink, Pan, Kellett and Hall, issued May 16, 1995. Suitable monomers for the above SRA include Na 2-(2-hydroxyethoxy)-ethanesulfonate, DMT, Na- dimethyl 5-sulfoisophthalate, EG and PG.

Yet another group of preferred SRA's are oligomeric esters comprising: (1) a backbone comprising (a) at least one unit selected from the group consisting of dihydroxysulfonates, polyhydroxy sulfonates, a unit which is at least trifunctional whereby ester linkages are formed resulting in a branched oligomer backbone, and combinations thereof; (b) at least one unit which is a terephthaloyl moiety; and (c) at least one unsulfonated unit which is a 1,2-oxyalkyleneoxy moiety; and (2) one or more capping units selected from nonionic capping units, anionic capping units such as alkoxylated, preferably ethoxylated, isethionates, alkoxylated propanesulfonates, alkoxylated propanedisulfonates, alkoxylated phenolsulfonates, sulfoaroyl derivatives and mixtures thereof. Preferred of such esters are those of empirical formula:

$$\{(CAP)x(EG/PG)y'(DEG)y''(PEG)y'''(T)z(SIP)z'(SEG)q(B)m\}$$

wherein CAP, EG/PG, PEG, T and SIP are as defined hereinabove, (DEG) represents di(oxyethylene)oxy units; (SEG) represents units derived from the sulfoethyl ether of glycerin and related moiety units; (B) represents branching units which are at least trifunctional whereby ester linkages are formed resulting in a branched oligomer backbone; x is from about 1 to about 12; y' is from about 0.5 to about 25; y" is from 0 to about 12; y'" is from 0 to about 10; y'+y"+y'" totals from about 0.5 to about 25; z' is from about 1.5 to about 25; z' is from 0 to about 12; z +z' totals from about 1.5 to about 25; q is from about 0.05 to about 12; m is from about 0.01 to about 10; and x, y', y", y'", z, z', q and m represent the average number of moles of the corresponding units per mole of said ester and said ester has a molecular weight ranging from about 500 to about 5,000.

Preferred SEG and CAP monomers for the above esters include Na-2-(2-,3-dihydroxypropoxy)ethanesulfonate ("SEG"), Na-2-{2-(2-hydroxyethoxy)ethoxy} ethanesulfonate ("SE3") and its homologs and mixtures thereof and the products of ethoxylating and sulfonating allyl alcohol. Preferred SRA esters in this class include the product of transesterifying and oligomerizing sodium 2-{2-(2-hydroxyethoxy)ethoxy}ethanesulfonate and/or sodium 2-[2-{2-(2-hydroxyethoxy)ethoxy}ethoxy]ethanesulfonate, DMT, sodium 2-(2,3-dihydroxypropoxy) ethane sulfonate, EG, and PG using an appropriate Ti(IV) catalyst and can be designated as (CAP)2(T)5(EG/PG)1.4(SEG)2.5(B)0.13 wherein CAP is (Na+—$O_3S[CH_2CH_2O]3.5$)— and B is a unit from glycerin and the mole ratio EG/PG is about 1.7:1 as measured by conventional gas chromatography after complete hydrolysis.

Additional classes of SRA's include (I) nonionic terephthalates using diisocyanate coupling agents to link up polymeric ester structures, see U.S. Pat. No. 4,201,824, Violland et al. and U.S. Pat. No. 4,240,918 Lagasse et al; (II) SRA's with carboxylate terminal groups made by adding trimellitic anhydride to known SRA's to convert terminal hydroxyl groups to trimellitate esters. With a proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al.; (III) anionic terephthalate-based SRA's of the urethane-linked variety, see U.S. Pat. No. 4,201,824, Violland et al; (IV) poly(vinyl caprolactam) and related co-polymers with monomers such as vinyl pyrrolidone and/or dimethylaminoethyl methacrylate, including both nonionic and cationic polymers, see U.S. Pat. No. 4,579,681, Ruppert et al.; (V) graft copolymers, in addition to the SOKALAN types from BASF made, by grafting acrylic monomers on to sulfonated polyesters; these SRA's assertedly have soil release and anti-redeposition activity similar to known cellulose ethers: see EP 279,134 A, 1988, to Rhone-Poulenc Chemie; (VI) grafts of vinyl monomers such as acrylic acid and vinyl acetate on to proteins such as caseins, see EP 457,205 A to BASF (1991); (VII) polyester-polyamide SRA's prepared by condensing adipic acid, caprolactam, and polyethylene glycol, especially for treating polyamide fabrics, see Bevan et al, DE 2,335,044 to Unilever N. V., 1974. Other useful SRA's are described in U.S. Pat. Nos. 4,240,918, 4,787,989, 4,525,524 and 4,877,896.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

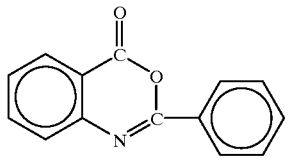

Still another class of preferred bleach activators includes the acyl lactam activators, especially acyl caprolactams and acyl valerolactams of the formulae:

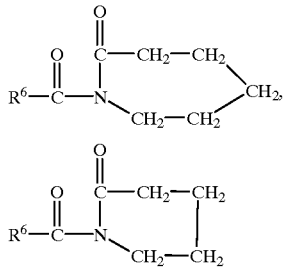

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3(1,4,7\text{-trimethyl-}1,4,7\text{-triazacyclononane})_2\text{-}(PF_6)_2$, $Mn^{III}_2(u\text{-}O)_1(u\text{-}OAc)_2(1,4,7\text{-trimethyl-}1,4,7\text{-triazacyclononane})_2(ClO_4)_2$, $Mn^{IV}_4(u\text{-}O)_6(1,4,7\text{-triazacyclononane})_4(ClO_4)_4$, $Mn^{III}Mn^{IV}_4(u\text{-}O)_1(u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Cobalt bleach catalysts useful herein are known, and are described, for example, in M. L. Tobe, "Base Hydrolysis of Transition-Metal Complexes", *Adv. Inorg. Bioinorg. Mech.,* (1983), 2, pages 1–94. The most preferred cobalt catalyst useful herein are cobalt pentaamine acetate salts having the formula $[Co(NH_3)_5OAc]\ T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

These cobalt catalysts are readily prepared by known procedures, such as taught for example in the Tobe article and the references cited therein, in U.S. Pat. No. 4,810,410, to Diakun et al, issued Mar. 7,1989, *J. Chem. Ed.* (1989), 66 (12), 1043–45; The Synthesis and Characterization of Inorganic Compounds, W. L. Jolly (Prentice-Hall; 1970), pp. 461–3; *Inorg. Chem.*, 18, 1497–1502 (1979); *Inorg. Chem.,* 21, 2881–2885 (1982); *Inorg. Chem.,* 18, 2023–2025 (1979); Inorg. Synthesis, 173–176 (1960); and *Journal of Physical Chemistry*, 56, 22–25 (1952).

As a practical matter, and not by way of limitation, the automatic dishwashing compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst, especially manganese or cobalt catalysts, by weight of the cleaning compositions.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Brightener—Any optical brighteners or other brightening or whitening agents known in the art can be incorporated at levels typically from about 0.01% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, the 2-(4-styryl-phenyl)-2H-naptho[1,2-d]triazoles; 4,4'-bis-(1,2,3-triazol-2-yl)-stilbenes; 4,4'-bis(styryl) bisphenyls; and the amino-coumarins. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1,2-d]oxazole; and 2-(stilben-4-yl)-2H-naphtho[1,2-d]triazole. See also U.S. Pat. No. 3,646,015, issued Feb. 29, 1972 to Hamilton.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O) O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

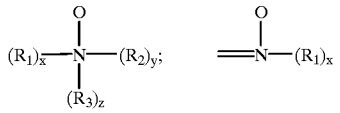

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of about 50,000 and an amine to amine N-oxide ratio of about 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

The detergent compositions herein may also optionally contain from about 0.005% to 5% by weight of certain types of hydrophilic optical brighteners which also provide a dye transfer inhibition action. If used, the compositions herein will preferably comprise from about 0.01% to 1% by weight of such optical brighteners.

The hydrophilic optical brighteners useful in the present invention are those having the structural formula:

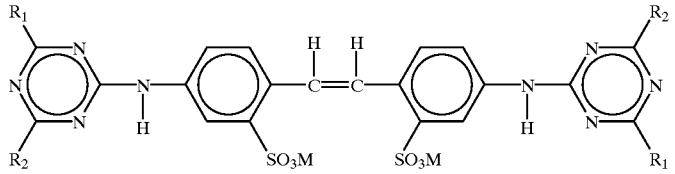

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder useful with, for example, insoluble builders such as zeolites, layered silicates and the like.

If utilized, these chelating agents will generally comprise from about 0.1% to about 15% by weight of the detergent compositions herein. More preferably, if utilized, the chelating agents will comprise from about 0.1% to about 3.0% by weight of such compositions.

Suds Suppressors—Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1,500 cs. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from about 0.001 to about 1, preferably from about 0.01 to about 0.7, most preferably from about 0.05 to about 0.5, weight % of said silicone uds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. Similar amounts can be used in granular compositions, gels, etc. See also U.S. Pat. Nos. 4,978,471, Starch, issued Dec. 18, 1990, and U.S. Pat. No. 4,983,316, Starch, issued Jan. 8, 1991, U.S. Pat. No. 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 weight %, preferably more than about 5 weight %.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol + silicone at a weight ratio of 1:5 to 5:1.

For any detergent compositions to be used in automatic laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 10% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Alkoxylated Polycarboxylates—Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—(CH_2CH_2O)_m(CH_2)_nCH_3$ wherein m is 2–3 and n is 6–12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Several perfume formulations are set forth in Example XXI, hereinafter. Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxyphenyl-butanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; beta-naphthol methyl ether; ambroxane; dodecahydro-3α, 6,6,9a-tetramethylnaphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl) cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)-propionaldehyde; 7-acetyl-1,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate; beta-napthol methyl ether; methyl beta-naphthyl ketone; 2-methyl-2-(para-iso-propylphenyl)propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.5 and 10.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

In the following Examples, the abbreviations for the various ingredients used for the compositions have the following meanings.

| | |
|---|---|
| LAS | C11.5 average chain length alkyl benzene sulfonate anionic surfactant, preferably sodium salt |
| AS | C14–15 average chain length primary alkyl sulfate anionic surfactant, preferably sodium salt |
| NI | C12–15 ethoxylated alcohol with an average EO9 degree of ethoxylation (nonionic surfactant) |
| SKS-6 | Layered silicate, ex. Hoechst |
| Copolymer | Copolymer of acrylic/maleic acids, sodium salt |
| Zeolite | 1–10 Micron zeolite A |
| PEG4000 | Polyethylene glycol; average molecular weight 4000 |
| NOBS | Nonanoyloxybenzene sulfonate bleach activator |
| PB-1 | Sodium perborate monohydrate |
| Protease | Proteolytic detergent enzymes as disclosed above; including BIOSAM 3.0. |

-continued

| | |
|---|---|
| Amylase | Amylolytic detergent enzymes |
| SRA-1 | Soil release agent; methyl cellulose; molecular weight about 13000, degree of substitution 1.8–1.9 |
| SRA-2 | Soil release agent per U.S. Pat. No. 5,415,807 |
| Brightener X | Tinopal® CBS-X; Distyryl Biphenyl Disulfonate class; Ciba-Geigy |
| Brightener Y | Tinopal® UNPA-GX; Cynauric chloride/Diamino stilbene class; Ciba-Geigy |
| Suds Control | Silica/silicone suds suppressor |

Granules Manufacture

Adding the alkoxylated cationics of this invention into a crutcher mix, followed by conventional spray drying, helps remove any residual, potentially malodorous, short-chain amine contaminants. In the event the formulator wishes to prepare an admixable particle containing the alkoxylated cationics for use in, for example, a high density granular detergent, it is preferred that the particle composition not be highly alkaline. Processes for preparing high density (above 540 g/l) granules are described in U.S. Pat. No. 5,366,652. Such particles may be formulated to have an effective pH in-use of 9, or below, to avoid the odor of impurity amines. This can be achieved by adding a small amount of acidity source such as boric acid, citric acid, or the like, or an appropriate pH buffer, to the particle. In an alternate mode, the prospective problems associated with amine malodors can be masked by use of perfume ingredients, as disclosed herein.

The following examples are illustrative of the present invention, but are not meant to limit or otherwise define its scope. All parts, percentages and ratios used herein are expressed as percent weight unless otherwise specified.

Examples I and II illustrate granular laundry detergents according to this invention.

EXAMPLE I

| INGREDIENTS | % (wt.) | ppm |
|---|---|---|
| Surfactant | | |
| LAS | 21.47 | 143.20 |
| AS | 6.55 | 43.69 |
| NI | 3.30 | 22.01 |
| AQA-1* | 0.47 | 3.13 |
| Builder-Alkalinity | | |
| SKS-6 | 3.29 | 21.94 |
| Copolymer | 7.10 | 47.36 |
| Zeolite | 8.40 | 56.03 |
| PEG4000 | 0.19 | 1.27 |
| Carbonate, Na | 17.84 | 118.99 |
| Silicate (2.0 R) | 11.40 | 76.04 |
| Bleach | | |
| NOBS | 4.05 | 27.01 |
| PB-1 | 3.92 | 26.15 |
| Enzyme | | |
| Protease | 0.85 | 5.67 |
| Amylase | 1.20 | 8.00 |
| Others | | |
| SRA-1 | 0.26 | 1.73 |
| SRA-2 | 0.26 | 1.73 |
| Brightener X | 0.21 | 1.40 |
| Brightener Y | 0.10 | 0.67 |
| Hydrophobic silica | 0.30 | 2.00 |
| Suds control | 0.17 | 1.13 |

EXAMPLE I-continued

| INGREDIENTS | % (wt.) | ppm |
|---|---|---|
| Sulfate, Na | 5.14 | 34.28 |
| Perfume | 0.25 | 1.67 |
| Misc. minors and moisture | 3.28 | 21.88 |
| TOTAL To: | 100 | 667.00 |

Dosage - 20 g/30 L

*The AQA-1 surfactant of the Example may be replaced by an equivalent amount of any of surfactants AQA-2 through AQA-22 or other AQA surfactants herein.

EXAMPLE II

| INGREDIENTS | % (wt.) | ppm |
|---|---|---|
| Surfactant | | |
| LAS | 21.47 | 143.20 |
| AS | 6.55 | 43.69 |
| NI | 3.30 | 22.01 |
| AQA-1* | 0.47 | 3.13 |
| Builder-Alkalinity | | |
| SKS-6 | 3.29 | 21.94 |
| Copolymer | 7.10 | 47.36 |
| Zeolite | 8.40 | 56.03 |
| PEG4000 | 0.19 | 1.27 |
| Carbonate, Na | 19.04 | 127.00 |
| Silicate (2.0 R) | 11.40 | 76.04 |
| Bleach | | |
| NOBS | 4.05 | 27.01 |
| PB-1 | 3.92 | 26.15 |
| Enzyme | | |
| Protease | 0.85 | 5.67 |
| Others | | |
| SRA-1 | 0.26 | 1.73 |
| SRA-2 | 0.26 | 1.73 |
| Brightener X | 0.21 | 1.40 |
| Brightener Y | 0.10 | 0.67 |
| Hydrophobic silica | 0.30 | 2.00 |
| Suds control | 0.17 | 1.13 |
| Sulfate, Na | 5.14 | 34.28 |
| Perfume | 0.25 | 1.67 |
| Misc., minors and moisture | 3.28 | 21.88 |
| TOTAL To: | 100 | 667.00 |

*The AQA-1 surfactant of the Example may be replaced by an equivalent amount of any of surfactants AQA-2 through AQA-22 or other AQA surfactants herein.

In the following examples, the abbreviated component identifications have the following meanings:

| | |
|---|---|
| LAS | Sodium linear $C_{12}$ alkyl benzene sulfonate |
| TAS | Sodium tallow alkyl sulfate |
| C45AS | Sodium $C_{14}$–$C_{15}$ linear alkyl sulfate |
| CxyEzS | Sodium $C_{1x}$–$C_{1y}$ branched alkyl sulfate condensed with z moles of ethylene oxide |
| C45E7 | A $C_{14-15}$ predominantly linear primary alcohol condensed with an average of 7 moles of ethylene oxide |
| C25E3 | A $C_{12-15}$ branched primary alcohol condensed with an average of 3 moles of ethylene oxide |
| C25E5 | A $C_{12-15}$ branched primary alcohol condensed with an average of 5 moles of ethylene oxide |
| CocoEO2 | $R_1.N^+(CH_3)(C_2H_4OH)_2$ with $R_1$ = $C_{12}$–$C_{14}$ |

-continued

| | |
|---|---|
| Soap | Sodium linear alkyl carboxylate derived from an 80/20 mixture of tallow and coconut oils. |
| TFAA | $C_{16}$–$C_{18}$ alkyl N-methyl glucamide |
| TPKFA | C12–C14 topped whole cut fatty acids |
| STPP | Anhydrous sodium tripolyphosphate |
| Zeolite A | Hydrated Sodium Aluminosilicate of formula $Na_{12}(A10_2SiO_2)_{12}.27H_2O$ having a primary particle size in the range from 0.1 to 10 micrometers |
| NaSKS-6 | Crystalline layered silicate of formula $\delta$-$Na_2Si_2O_5$ |
| Citric acid | Anhydrous citric acid |
| Carbonate | Anhydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous Sodium Silicate ($SiO_2$:$Na_2O$; 2.0 ratio) |
| Sodium sulfate | Anhydrous sodium sulfate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000. |
| CMC | Sodium carboxymethyl cellulose |
| Protease | Proteolytic enzyme of activity 4KNPU/g sold by NOVO Industries A/S under the tradename Savinase |
| Alcalase | Proteolytic enzyme of activity 3AU/g sold by NOVO Industries A/S |
| Cellulase | Cellulytic enzyme of activity 1000 CEVU/g sold by NOVO Industries A/S under the tradename Carezyme |
| Amylase | Amylolytic enzyme of activity 6OKNU/g sold by NOVO Industries A/S under the tradename Termamyl 60T |
| Lipase | Lipolytic enzyme of activity 100kLU/g sold by NOVO Industries A/S under the tradename Lipolase |
| Endolase | Endoglunase enzyme of activity 3000 CEVU/g sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium Percarbonate of nominal formula $2Na_2CO_3.3H_2O_2$ |
| NOBS | Nonanoyloxybenzene sulfonate in the form of the sodium salt. |
| TAED | Tetraacetylethylenediamine |
| DTPMP | Diethylene triamine penta (methylene phosphonate), marketed by Monsanto under the Trade name Dequest 2060 |
| Photoactivated | Sulfonated Zinc Phthlocyanine encapsulated in bleach dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate. |
| HEDP | 1,1-hydroxyethane diphosphonic acid |
| PVNO | Polyvinylpyridine N-oxide |
| PVPVI | Copolymer of polyvinylpyrrolidone and vinylimidazole |
| SRA 1 | Sulfobenzoyl end capped esters with oxyethylene oxy and terephthaloyl backbone |
| SRA 2 | Diethoxylated poly (1,2 propylene terephthalate) short block polymer |
| Silicone antifoam | Polydimethylsiloxane foam controller with siloxane-oxyalkylene copolymer as dispersing agent with a ratio of said foam controller to said dispersing agent of 10:1 to 100:1. |

In the following Examples all levels are quoted as % by weight of the composition.

EXAMPLE III

The following detergent formulations, according to the present invention are prepared, where A and C are phosphorus-containing detergent compositions and B is a zeolite-containing detergent composition.

| | A | B | C |
|---|---|---|---|
| Blown Powder | | | |
| STPP | 24.0 | — | 24.0 |
| Zeolite A | — | 24.0 | — |
| C45AS | 8.0 | 5.0 | 11.0 |
| MA/AA | 2.0 | 4.0 | 2.0 |
| LAS | 6.0 | 8.0 | 11.0 |
| TAS | 1.5 | — | — |
| AQA-1* | 1.5 | 1.0 | 2.0 |
| Silicate | 7.0 | 3.0 | 3.0 |
| CMC | 1.0 | 1.0 | 0.5 |
| Brightener 2 | 0.2 | 0.2 | 0.2 |
| Soap | 1.0 | 1.0 | 1.0 |
| DTPMP | 0.4 | 0.4 | 0.2 |
| Spray On | | | |
| C45E7 | 2.5 | 2.5 | 2.0 |
| C25E3 | 2.5 | 2.5 | 2.0 |
| Silicone antifoam | 0.3 | 0.3 | 0.3 |
| Perfume | 0.3 | 0.3 | 0.3 |
| Dry additives | | | |
| Carbonate | 6.0 | 13.0 | 15.0 |
| PB4 | 18.0 | 18.0 | 10.0 |
| PB1 | 4.0 | 4.0 | 0 |
| TAED | 3.0 | 3.0 | 1.0 |
| Photoactivated bleach | 0.02 | 0.02 | 0.02 |
| Protease | 1.0 | 1.0 | 1.0 |
| Lipase | 0.4 | 0.4 | 0.4 |
| Amylase | 0.25 | 0.30 | 0.15 |
| Dry mixed sodium sulfate | 3.0 | 3.0 | 5.0 |
| Balance (Moisture & Miscellaneous) To: | 100.0 | 100.0 | 100.0 |
| Density (g/litre) | 630 | 670 | 670 |

*The AQA-1 surfactant of the Example may be replaced by an equivalent amount of any of surfactants AQA-2 through AQA-22 or other AQA surfactants herein.

EXAMPLE IV

The following nil bleach-containing detergent formulations are of particular use in the washing of colored clothing.

| | D | E | F |
|---|---|---|---|
| Blown Powder | | | |
| Zeolite A | 15.0 | 15.0 | 2.5 |
| Sodium sulfate | 0.0 | 5.0 | 1.0 |
| LAS | 2.0 | 2.0 | — |
| AQA-1* | 1.0 | 1.0 | 1.5 |
| DTPMP | 0.4 | 0.5 | — |
| CMC | 0.4 | 0.4 | — |
| MA/AA | 4.0 | 4.0 | — |
| Agglomerates | | | |
| C45AS | — | — | 9.0 |
| LAS | 6.0 | 5.0 | 2.0 |
| TAS | 3.0 | 2.0 | — |
| Silicate | 4.0 | 4.0 | — |
| Zeolite A | 10.0 | 15.0 | 13.0 |
| CMC | — | — | 0.5 |
| MA/AA | — | — | 2.0 |
| Carbonate | 9.0 | 7.0 | 7.0 |
| Spray On | | | |
| Perfume | 0.3 | 0.3 | 0.5 |
| C45E7 | 4.0 | 4.0 | 4.0 |
| C25E3 | 2.0 | 2.0 | 2.0 |

-continued

| | D | E | F |
|---|---|---|---|
| Dry additives | | | |
| MA/AA | — | — | 3.0 |
| NaSKS-6 | — | — | 12.0 |
| Citrate | 10.0 | — | 8.0 |
| Bicarbonate | 7.0 | 3.0 | 5.0 |
| Carbonate | 8.0 | 5.0 | 7.0 |
| PVPVI/PVNO | 0.5 | 0.5 | 0.5 |
| Alcalase | 0.5 | 0.3 | 0.9 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 9.0 | 0.0 |
| Balance (Moisture & Miscellaneous) To: | 100.0 | 100.0 | 100.0 |
| Density (g/litre) | 700 | 700 | 850 |

*The AQA-1 surfactant of the Example may be replaced by an equivalent amount of any of surfactants AQA-2 through AQA-22 or other AQA surfactants herein.

EXAMPLE V

The following detergent formulations, according to the present invention are prepared:

| | G | H | I |
|---|---|---|---|
| Blown Powder | | | |
| Zeolite A | 30.0 | 22.0 | 6.0 |
| Sodium sulfate | 19.0 | 5.0 | 7.0 |
| MA/AA | 3.0 | 3.0 | 6.0 |
| LAS | 13.0 | 11.0 | 21.0 |
| C45AS | 8.0 | 7.0 | 7.0 |
| AQA-1* | 1.0 | 1.0 | 1.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 20.0 |
| DTPMP | — | 0.4 | 0.4 |
| Spray On | | | |
| C45E7 | 1.0 | 1.0 | 1.0 |
| Dry additives | | | |
| PVPVI/PVNO | 0.5 | 0.5 | 0.5 |
| Protease | 1.0 | 1.0 | 1.0 |
| Lipase | 0.4 | 0.4 | 0.4 |
| Amylase | 0.1 | 0.1 | 0.1 |
| Cellulase | 0.1 | 0.1 | 0.1 |
| NOBS | — | 6.1 | 4.5 |
| PB1 | 1.0 | 5.0 | 6.0 |
| Sodium sulfate | — | 6.0 | — |
| Balance (Moisture & Miscellaneous) To: | 100 | 100 | 100 |

*The AQA-1 surfactant of the Example may be replaced by an equivalent amount of any of surfactants AQA-2 through AQA-22 or other AQA surfactants herein.

EXAMPLE VI

The following high density and bleach-containing detergent formulations, according to the present invention are prepared:

| | J | K | L |
|---|---|---|---|
| Blown Powder | | | |
| Zeolite A | 15.0 | 15.0 | 15.0 |
| Sodium sulfate | 0.0 | 5.0 | 0.0 |
| LAS | 3.0 | 3.0 | 3.0 |
| AQA-1 | 1.0 | 1.5 | 1.5 |
| DTPMP | 0.4 | 0.4 | 0.4 |
| CMC | 0.4 | 0.4 | 0.4 |
| MA/AA | 4.0 | 2.0 | 2.0 |
| Agglomerates | | | |
| LAS | 5.0 | 5.0 | 5.0 |
| TAS | 2.0 | 2.0 | 1.0 |
| Silicate | 3.0 | 3.0 | 4.0 |
| Zeolite A | 8.0 | 8.0 | 8.0 |
| Carbonate | 8.0 | 8.0 | 4.0 |
| Spray On | | | |
| Perfume | 0.3 | 0.3 | 0.3 |
| C45E7 | 2.0 | 2.0 | 2.0 |
| C25E3 | 2.0 | — | — |
| Dry additives | | | |
| Citrate | 5.0 | — | 2.0 |
| Bicarbonate | — | 3.0 | — |
| Carbonate | 8.0 | 15.0 | 10.0 |
| TAED | 6.0 | 2.0 | 5.0 |
| PB1 | 13.0 | 7.0 | 10.0 |
| Polyethylene oxide of MW 5,000,000 | — | — | 0.2 |
| Bentonite clay | — | — | 10.0 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 3.0 | 0.0 |
| Balance (Moisture & Miscellaneous) To: | 100.0 | 100.0 | 100.0 |
| Density (g/litre) | 850 | 850 | 850 |

*The AQA-1 surfactant of the Example may be replaced by an equivalent amount of any of surfactants AQA-2 through AQA-22 or other AQA surfactants herein.

EXAMPLE VII

The following high density detergent formulations according to the present invention are prepared:

| | M | N |
|---|---|---|
| Blown Powder | | |
| Zeolite A | 2.5 | 2.5 |
| Sodium sulfate | 1.0 | 1.0 |
| AQA-1* | 1.5 | 1.5 |
| Agglomerate | | |
| C45AS | 11.0 | 14.0 |
| Zeolite A | 15.0 | 6.0 |
| Carbonate | 4.0 | 8.0 |
| MA/AA | 4.0 | 2.0 |
| CMC | 0.5 | 0.5 |
| DTPMP | 0.4 | 0.4 |
| Spray On | | |
| C25E5 | 5.0 | 5.0 |
| Perfume | 0.5 | 0.5 |
| Dry Adds | | |
| HEDP | 0.5 | 0.3 |

-continued

| | M | N |
|---|---|---|
| SKS6 | 13.0 | 10.0 |
| Citrate | 3.0 | 1.0 |
| TAED | 5.0 | 7.0 |
| Percarbonate | 15.0 | 15.0 |
| SRP 1 | 0.3 | 0.3 |
| Protease | 1.4 | 1.4 |
| Lipase | 0.4 | 0.4 |
| Cellulase | 0.6 | 0.6 |
| Amylase | 0.6 | 0.6 |
| Silicone antifoam | 5.0 | 5.0 |
| Brightener 1 | 0.2 | 0.2 |
| Brightener 2 | 0.2 | — |
| Balance (Moisture & Miscellaneous) To: | 100 | 100 |
| Density (g/litre) | 850 | 850 |

*The AQA-1 surfactant of the Example may be replaced by an equivalent amount of any of surfactants AQA-2 through AQA-22 or other AQA surfactants herein.

EXAMPLE VIII

The following liquid detergent formulations according to the present invention are prepared:

| | O | P | Q | R | S |
|---|---|---|---|---|---|
| LAS | 10.0 | 13.0 | 9.0 | 2.0 | 15.0 |
| C25AS | 4.0 | 1.0 | 2.0 | 8.0 | 10.0 |
| C25E3S | 1.0 | — | — | 3.0 | — |
| C25E7 | 5.5 | 7.0 | 11.0 | 2.0 | — |
| TFAA | — | — | — | 3.5 | — |
| AQA-1* | 0.5 | 1.0 | 2.0 | 1.5 | 3.0 |
| TPKFA | 2.0 | — | 13.0 | 2.0 | — |
| Rapeseed fatty acids | — | — | — | 5.0 | — |
| Citric acid | 2.0 | 3.0 | 1.0 | 1.5 | 1.0 |
| Dodecenyl/tetradecenyl succinic acid | 12.0 | 10.0 | — | — | 15.0 |
| Oleic acid | 4.0 | 2.0 | 1.0 | — | 1.0 |
| Ethanol | 4.0 | 4.0 | 7.0 | 2.0 | 7.0 |
| 1,2 Propanediol | 4.0 | 4.0 | 2.0 | 7.0 | 6.0 |
| Mono Ethanol Amine | — | — | — | 5.0 | — |
| Tri Ethanol Amine | — | — | 8 | — | — |
| NaOH up to pH | 8.0 | 8.0 | 7.6 | 7.7 | 8.0 |
| Ethoxylated tetraethylene pentamine | 0.5 | — | 0.5 | 0.2 | — |
| DTPMP | 1.0 | 1.0 | 0.5 | 1.0 | 2.0 |
| SRP2 | 0.3 | — | 0.2 | 0.1 | — |
| PVNO | — | — | 0.1 | — | — |
| Protease | 0.5 | 0.5 | 0.4 | 0.25 | — |
| Alcalase | — | — | — | — | 1.5 |
| Lipase | — | 0.10 | — | 0.01 | — |
| Amylase | 0.25 | 0.25 | 0.6 | 0.5 | 0.25 |
| Cellulase | — | — | — | 0.05 | — |
| Endolase | — | — | — | 0.10 | — |
| Boric acid | 0.1 | 0.2 | — | 2.0 | 1.0 |
| Na formate | — | — | 1.0 | — | — |
| Ca chloride | — | 0.015 | — | 0.01 | — |
| Bentonite clay | — | — | — | — | 4.0 |
| Suspending clay SD3 | — | — | — | — | 0.6 |
| Balance (Moisture & Miscellaneous) To: | 100 | 100 | 100 | 100 | 100 |

*The AQA-1 surfactant of the Example may be replaced by an equivalent amount of any of surfactants AQA-2 through AQA-22 or other AQA surfactants herein.

The following Example IX further illustrates the invention herein with respect to laundry granules.

EXAMPLE IX

The compositions of Examples I and II are modified by removing the bleach system (NOBS/$PB_1$). The AQA-1 is replaced by AQA-15 at a level of about 1.5% of the composition (range 0.5–5%). Quite satisfactory cleaning performance on a variety of soils and stains is secured even in the absence of bleach, and surprisingly, in both hard and soft water.

The manufacture of heavy duty liquid detergent compositions, especially those designed for fabric laundering, which comprise a non-aqueous carrier medium can be conducted in the manner disclosed in more detail hereinafter. In an alternate mode, such non-aqueous compositions can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. No. 4,988,462; U.S. Pat. No. 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients (e.g., bleaching agents, as disclosed hereinabove) stably suspended therein. Such non-aqueous compositions thus comprise a LIQUID PHASE and, optionally but preferably, a SOLID PHASE, all as described in more detail hereinafter and in the cited references. The AQA surfactants are incorporated in the compositions at the levels and in the manner described hereinabove for the manufacture of other laundry detergent compositions.

LIQUID PHASE

The liquid phase will generally comprise from about 35% to 99% by weight of the detergent compositions herein. More preferably, the liquid phase will comprise from about 50% to 95% by weight of the compositions. Most preferably, the liquid phase will comprise from about 45% to 75% by weight of the compositions herein. The liquid phase of the detergent compositions herein essentially contains relatively high concentrations of a certain type anionic surfactant combined with a certain type of nonaqueous, liquid diluent.

(A) Essential Anionic Surfactant

The anionic surfactant essentially utilized as an essential component of the nonaqueous liquid phase is one selected from the alkali metal salts of alkylbenzene sulfonic acids in which the alkyl group contains from about 10 to 16 carbon atoms, in straight chain or branched chain configuration. (See U.S. Pat. Nos. 2,220,099 and 2,477,383, incorporated herein by reference.) Especially preferred are the sodium and potassium linear straight chain alkylbenzene sulfonates (LAS) in which the average number of carbon atoms in the alkyl group is from about 11 to 14. Sodum $C_{11}$–$C_{14}$ LAS is especially preferred.

The alkylbenzene sulfonate anionic surfactant will be dissolved in the nonaqueous liquid diluent which makes up the second essential component of the nonaqueous phase. To form the structured liquid phase required for suitable phase stability and acceptable rheology, the alkylbenzene sulfonate anionic surfactant is generally present to the extent of from about 30% to 65% by weight of the liquid phase. More preferably, the alkylbenzene sulfonate anionic surfactant will comprise from about 35% to 50% by weight of the nonaqueous liquid phase of the compositions herein. Utilization of this anionic surfactant in these concentrations corresponds to an anionic surfactant concentration in the total composition of from about 15% to 60% by weight, more preferably from about 20% to 40% by weight, of the composition.

(B) Nonaqueous Liquid Diluent

To form the liquid phase of the detergent compositions, the hereinbefore described alkylbenzene sulfonate anionic surfactant is combined with a nonaqueous liquid diluent which contains two essential components. These two components are a liquid alcohol alkoxylate material and a nonaqueous, low-polarity organic solvent.

i) Alcohol Alkoxylates

One essential component of the liquid diluent used to form the compositions herein comprises an alkoxylated fatty alcohol material. Such materials are themselves also nonionic surfactants. Such materials correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol component of the liquid diluent will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful as one of the essential components of the nonaqueous liquid diluent in the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1–5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

The alcohol alkoxylate component which is essentially utilized as part of the liquid diluent in the nonaqueous compositions herein will generally be present to the extent of from about 1% to 60% of the liquid phase composition. More preferably, the alcohol alkoxylate component will comprise about 5% to 40% of the liquid phase. Most preferably, the essentially utilized alcohol alkoxylate component will comprise from about 5% to 30% of the detergent composition liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 5% to 25% by weight, of the composition.

ii) Nonaqueous Low-Polarity Organic Solvent

A second essential component of the liquid diluent which forms part of the liquid phase of the detergent compositions herein comprises nonaqueous, low-polarity organic solvent (s). The term "solvent" is used herein to connote the non-surface active carrier or diluent portion of the liquid phase of the composition. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The nonaqueous organic materials which are employed as solvents herein are those which are liquids of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol should not be utilized. Suitable types of low-polarity solvents useful in the nonaqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of nonaqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of nonaqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropylene glycol monoethyl ether, and dipropylene glycol monobutyl ether. Diethylene glycol monobutyl ether and dipropylene glycol monobutyl ether are especially preferred. Compounds of the type have been commercially marketed under the tradenames Dowanol, Carbitol, and Cellosolve.

Another preferred type of nonaqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, nonaqueous solvent comprises lower molecular weight methyl esters. Such materials are those of the general formula:

$$R^1—C(O)—OCH_3$$

wherein $R^1$ ranges from 1 to about 18. Examples of suitable lower molecular weight methyl esters include methyl acetate, methyl propionate, methyl octanoate, and methyl dodecanoate.

The nonaqueous, low-polarity organic solvent(s) employed should, of course, be compatible and non-reactive with other composition components, e.g., bleach and/or activators, used in the liquid detergent compositions herein. Such a solvent component will generally be utilized in an amount of from about 1% to 70% by weight of the liquid phase. More preferably, the nonaqueous, low-polarity organic solvent will comprise from about 10% to 60% by weight of the liquid phase, most preferably from about 20% to 50% by weight, of the liquid phase of the composition. Utilization of this organic solvent in these concentrations in the liquid phase corresponds to a solvent concentration in the total composition of from about 1% to 50% by weight, more preferably from about 5% to 40% by weight, and most preferably from about 10% to 30% by weight, of the composition.

iii) Alcohol Alkoxylate To Solvent Ratio

The ratio of alcohol alkoxylate to organic solvent within the liquid diluent can be used to vary the rheological properties of the detergent compositions eventually formed. Generally, the weight ratio of alcohol alkoxylate to organic solvent will range from about 50:1 to 1:50. More preferably, this ratio will range from about 3:1 to 1:3.

iv) Liquid Diluent Concentration

As with the concentration of the alkylbenzene sulfonate anionic surfactant mixture, the amount of total liquid diluent in the nonaqueous liquid phase herein will be determined by the type and amounts of other composition components and by the desired composition properties. Generally, the liquid diluent will comprise from about 35% to 70% of the nonaqueous liquid phase of the compositions herein. More preferably, the liquid diluent will comprise from about 50% to 65% of the nonaqueous liquid phase. This corresponds to a nonaqueous liquid diluent concentration in the total composition of from about 15% to 70% by weight, more preferably from about 20% to 50% by weight, of the composition.

SOLID PHASE

The nonaqueous detergent compositions herein also essentially comprise from about 1% to 65% by weight, more preferably from about 5% to 50% by weight, of a solid phase of particulate material which is dispersed and suspended within the liquid phase. Generally such particulate material will range in size from about 0.1 to 1500 microns. More preferably such material will range in size from about 5 to 200 microns.

The particulate material utilized herein can comprise one or more types of detergent composition components which in particulate form are substantially insoluble in the nonaqueous liquid phase of the composition. The types of particulate materials which can be utilized are described in detail as follows:

COMPOSITION PREPARATION AND USE

The nonaqueous liquid detergent compositions herein can be prepared by combining the essential and optional components thereof in any convenient order and by mixing, e.g., agitating, the resulting component combination to form the phase stable compositions herein. In a typical process for preparing such compositions, essential and certain preferred optional components will be combined in a particular order and under certain conditions.

In the first step of such a typical preparation process, an admixture of the alkylbenzene sulfonate anionic surfactant and the two essential components of the nonaqueous diluent is formed by heating a combination of these materials to a temperature from about 30° C. to 100° C.

In a second process step, the heated admixture formed as hereinbefore described is maintained under shear agitation at a temperature from about 40° C. to 100° C. for a period of from about 2 minutes to 20 hours. Optionally, a vacuum can be applied to the admixture at this point. This second process step serves to completely dissolve the anionic surfactant in the nonaqueous liquid phase.

In a third process step, this liquid phase combination of materials is cooled to a temperature of from about 0° C. to 35° C. This cooling step serves to form a structured, surfactant-containing liquid base into which the particulate material of the detergent compositions herein can be added and dispersed.

Particulate material is added in a fourth process step by combining the particulate material with the liquid base which is maintained under conditions of shear agitation. When more than one type of particulate material is to be added, it is preferred that a certain order of addition be observed. For example, while shear agitation is maintained, essentially all of any optional surfactants in solid particulate form can be added in the form of particles ranging in size from about 0.2 to 1,000 microns. After addition of any optional surfactant particles, particles of substantially all of an organic builder, e.g., citrate and/or fatty acid, and/or an alkalinity source, e.g., sodium carbonate, can be added while continuing to maintain this admixture of composition components under shear agitation. Other solid form optional ingredients can then be added to the composition at this point. Agitation of the mixture is continued, and if necessary, can be increased at this point to form a uniform dispersion of insoluble solid phase particulates within the liquid phase.

After some or all of the foregoing solid materials have been added to this agitated mixture, the particles of the highly preferred peroxygen bleaching agent can be added to the composition, again while the mixture is maintained under shear agitation. By adding the peroxygen bleaching agent material last, or after all or most of the other components, and especially after alkalinity source particles, have been added, desirable stability benefits for the peroxygen bleach can be realized. If enzyme prills are incorporated, they are preferably added to the nonaqueous liquid matrix last.

As a final process step, after addition of all of the particulate material, agitation of the mixture is continued for a period of time sufficient to form compositions having the requisite viscosity and phase stability characteristics. Frequently this will involve agitation for a period of from about 1 to 30 minutes.

As a variation of the composition preparation procedure hereinbefore described, one or more of the solid components may be added to the agitated mixture as a slurry of particles premixed with a minor portion of one or more of the liquid components. Thus a premix of a small fraction of the alcohol alkoxylate and/or nonaqueous, low-polarity solvent with particles of the organic builder material and/or the particles of the inorganic alkalinity source and/or particles of a bleach activator may be separately formed and added as a slurry to the agitated mixture of composition components. Addition of such slurry premixes should precede addition of peroxygen bleaching agent and/or enzyme particles which may themselves be part of a premix slurry formed in analogous fashion.

The compositions of this invention, prepared as hereinbefore described, can be used to form aqueous washing solutions for use in the laundering and bleaching of fabrics. Generally, an effective amount of such compositions is added to water, preferably in a conventional fabric laundering automatic washing machine, to form such aqueous laundering/bleaching solutions. The aqueous washing/ bleaching solution so formed is then contacted, preferably under agitation, with the fabrics to be laundered and bleached therewith.

An effective amount of the liquid detergent compositions herein added to water to form aqueous laundering/bleaching solutions can comprise amounts sufficient to form from about 500 to 7,000 ppm of composition in aqueous solution. More preferably, from about 800 to 3,000 ppm of the detergent compositions herein will be provided in aqueous washing/bleaching solution.

EXAMPLE X

A non-limiting example of bleach-containing nonaqueous liquid laundry detergent is prepared having the composition as set forth in Table I.

TABLE I

| Component | Wt. % | Range (% wt.) |
|---|---|---|
| Liquid Phase | | |
| Na $C_{12}$ Linear alkylbenzene sulfonate (LAS) | 25.3 | 18–35 |
| $C_{12-14}$, EO5 alcohol ethoxylate | 13.6 | 10–20 |
| Hexylene glycol | 27.3 | 20–30 |
| Perfume | 0.4 | 0–1.0 |
| AQA-1* | 2.0 | 1–3.0 |
| Solids | | |
| Protease enzyme | 0.4 | 0–1.0 |
| $Na_3$ Citrate, anhydrous | 4.3 | 3–6 |
| Sodium perborate | 3.4 | 2–7 |
| Sodium nonanoyloxybenzene sulfonate (NOBS) | 8.0 | 2–12 |
| Sodium carbonate | 13.9 | 5–20 |
| Diethyl triamine pentaacetic acid (DTPA) | 0.9 | 0–1.5 |
| Brightener | 0.4 | 0–0.6 |
| Suds Suppressor | 0.1 | 0–0.3 |
| Minors | Balance | — |

*AQA-1 may be replaced by AQA surfactants 2–22 or other AQA surfactants herein.

The composition is prepared by mixing the AQA and LAS, then the hexylene glycol and alcohol ethoxylate, together at 54° C. (130° F.) for ½ hour. This mixture is then cooled to 29° C. (85° F.) whereupon the remaining components are added. The resulting composition is then stirred at 29° C. (85° F.) for another ½ hour.

The resulting composition is a stable anhydrous heavy duty liquid laundry detergent which provides excellent stain and soil removal performance when used in normal fabric laundering operations.

The foregoing Examples illustrate the present invention as it relates to fabric laundering compositions, whereas the following Examples are intended to illustrate other types of cleaning compositions according to this invention, but are not intended to be limiting thereof. In the following Examples, the adjunct materials used in combination with the AQA surfactants may, in some instances, be somewhat different from those disclosed hereinabove for use in fabric laundering compositions and processes, although they will be quite familiar to formulators of dishwashing products, hard surface cleaners, shampoos and the like. However, for the convenience of the formulator the following ingredients are listed by way of illustration and not for purposes of limitation.

Modern, high performance hand dishwashing compositions can contain ingredients which are designed to provide specific in-use product attributes such as grease cutting ability, high sudsing, mildness and skin feel benefits, and the like. Such ingredients for use with the AQA surfactants herein include, for example, amine oxide surfactants, betaine and/or sultaine surfactants, alkyl sulfate and alkyl ethoxy sulfate surfactants, liquid carriers, especially water and water/propylene glycol mixtures, natural oils such lemon oil, and the like. In addition, preferred liquid and/or gel hand dishwashing compositions may also contain calcium ions, magnesium ions, or mixtures of calcium/magnesium ions, which afford additional grease cutting performance advantages especially when used in combination with detersive mixtures comprising the AQA surfactant herein in combination with, for example, amine oxide, alkyl sulfates and alkyl ethoxy sulfates. Magnesium or calcium or mixed Mg/Ca ion sources typically comprise from about 0.01% to about 4%, preferably from about 0.02% to about 2%, by weight, of such compositions. Various water-soluble sources of these ions include, for example, sulfate, chloride and acetate salts. Moreover, these compositions may also contain nonionic surfactants, especially those of the polyhydroxy fatty acid amide and alkyl polyglucaside classes. Preferred are the $C_{12}$–$C_{14}$ (coconut alkyl) members of these classes. An especially preferred nonionic surfactant for use in hand dishwashing liquids is $C_{12}$–$C_{14}$ N-methylglucamide. Preferred amine oxides include $C_{12}$–$C_{14}$ dimethylamine oxide. The alkyl sulfates and alkyl ethoxy sulfates are as described hereinabove. Usage levels for such surfactants in dishwashing liquids is typically in the range from about 3% to about 50% of the finished composition. The formulation of dishwashing liquid compositions has been described in more detail in various patent publications including U.S. Pat. No. 5,378,409, U.S. Pat. No. 5,376,310 and U.S. Pat. No. 5,417,893, incorporated herein by reference.

Modem, high performance hard surface cleaners can contain various ingredients which contribute to grease cutting and/or removal of soap scum, and the like. In general, hard surface cleaners are formulated so as to be low sudsing; accordingly, the use of detersive surfactants of the type disclosed herein is typically limited to a range from about 0.5% to about 10%, by weight. Such compositions for use with the AQA surfactants herein can also contain, for example, citrate or phosphate builders, abrasives such as silica, mica, pumice, and the like. These compositions can also contain hypochlorite bleaches, percarbonate bleaches and sanitizing agents such as KATHON®, and the like.

Modern shampoo compositions can contain ingredients which cleanse the hair and scalp and are safe to the user, especially with regard to eye irritation. These compositions contain the AQA surfactants herein, as well as various hair conditioning agents, anti-dandruff agents, hair styling agents, anti-lice agents, and mixtures thereof Shampoo compositions are generally prepared using a fluid carrier and optional thickening agents. Included among the ingredients used in such compositions are silicone fluids and gums, especially those described in U.S. Pat. No. 2,826,551; U.S. Pat. No. 3,964,500; U.S. Pat. No. 4,364,837; and British 849,433. U.S. Pat. No. 3,742,855 can be referred to for details of the various silicones used in high performance shampoos as a hair conditioning agent. Various anti-dandruff agents are described, for example, in U.S. Pat. Nos. 3,236,733; 4,379,753 and 4,345,080. Non-limiting examples of such materials include the pyridinethione materials, various selenium compounds such as selenium sulfide and commercial materials such as OCTOPIROX®. Such anti-dandruff agents are typically used in shampoo compositions at levels of at least about 0.1% to about 4%, by weight. Various hair styling polymers, especially those wherein monomer components comprise vinylpyrrolidone can be used. Such polymer systems are described, for example, in U.S. Pat. Nos.

3,222,329; 3,577,517; 4,012,501; 4,272,511 and 4,196,190. Specific styling polymers include vinylpyrrolidone/vinylacetate copolymers, vinylacetate homopolymers, vinylpyrrolidone/vinylacetate/butylacrylate copolymers and styling resins sold under the tradenames ULTRAHOLD 8® by Ciba Geigy. Polymer styling agents are typically used in shampoo compositions in the range from about 0.2% to about 20%, by weight. Shampoo compositions can also contain pediculicides (anti-lice agents). Such materials include the natural and synthetic pyrethrins and pyrethroids, and mixtures thereof, typically at usage levels from about 0.1% to about 2.5%, by weight.

Modem personal cleansing bars or gels can include various high sudsing agents, such as the polyhydroxy fatty acid amide surfactants noted above, alkyl ethoxy sulfate surfactants or conventional $C_{10}$–$C_{18}$ fatty acid soaps (alkyl carboxylates). In addition, personal cleansing bars containing the AQA surfactants herein can comprise synthetic detersive surfactants as noted hereinabove. Various ancillary humectants and skin emulsifiers can optionally be included in such compositions, e.g., glycerol and glycerol esters. Other ingredients which conventionally are used in such bars and gels include lanolin and lanolin derivatives. Thickening agents such as carboxymethyl cellulose derivatives, algal extracts and the like, are typically used in gels to provide a thick, lubricious feel. Such ancillary ingredients typically comprise from about 1% to about 35%, by weight, of bars and gels.

Modern automatic dishwashing detergents can contain bleaching agents such as hypochlorite sources; perborate, percarbonate or persulfate bleaches; enzymes such as proteases, lipases and amylases, or mixtures thereof; rinse-aids, especially nonionic surfactants; builders, including zeolite and phosphate builders; low-sudsing detersive surfactants, especially ethylene oxide/propylene oxide condensates, and the like. Such compositions are typically in the form of granules or gels. If used in gel form, various gelling agents known in the literature can be employed.

The following Example further illustrates the invention herein with respect to a hand dishwashing liquid.

EXAMPLE XII

| Ingredient | % (wt.) | Range (% wt.) |
|---|---|---|
| AQA-1* | 2.0 | 0.15–3 |
| Ammonium $C_{12-13}$ alkyl sulfate | 7.0 | 2–35 |
| $C_{12}$–$C_{14}$ ethoxy (1) sulfate | 20.5 | 5–35 |
| Coconut amine oxide | 2.6 | 2–5 |
| Betaine/Tetronic 704 ® | 0.87–0.10 | 0–2 (mix) |
| Alcohol Ethoxylate $C_8E_{11}$ | 5.0 | 2–10 |
| Ammonium xylene sulfonate | 4.0 | 1–6 |
| Ethanol | 4.0 | 0–7 |
| Ammonium citrate | 0.06 | 0–1.0 |
| Magnesium chloride | 3.3 | 0–4.0 |
| Calcium chloride | 2.5 | 0–4.0 |
| Ammonium sulfate | 0.08 | 0–4.0 |
| Hydrogen peroxide | 200 ppm | 0–300 ppm |
| Perfume | 0.18 | 0–0.5 |
| Maxatase ® protease | 0.50 | 0–1.0 |
| Water and minors | Balance | |

*May be replaced by AQA2-10 or other AQA surfactants herein.
**Cocoalkyl betaine.

The following Example further illustrates the invention herein with respect to hard surface cleaners.

EXAMPLE XIII

| Ingredient | % (wt.) | Range (% wt.) |
|---|---|---|
| AQA-1* | 2.0 | 0.25–5 |
| 3-(N-dodecyl-N,N-dimethyl)-2-hydroxy-propane-1-sulfonate | 2.0 | 1–5 |
| Octyl polyethoxylate (2.5) | 1.1 | 1–5 |
| Octyl polyethoxylate (6.0) | 2.9 | 1–5 |
| Butoxy propoxy propanol | 5.0 | 0–10 |
| Succinic acid | 10.0 | 2–12 |
| Sodium cumene sulfonate | 4.2 | 1–5 |
| Water. buffering agents, and minors | Balance | |
| pH | 3.0 | |

*May be replaced by AQA2-10 or other AQA surfactants herein.

The following Example further illustrates the invention herein with respect to a shampoo.

EXAMPLE XIV

| Ingredient | % (wt.) | Range (% wt.) |
|---|---|---|
| AQA-1* | 1.5 | 0.5–3.0 |
| Lauryl sulfate, $NH_4$ | 3.5 | 2.0–5.0 |
| $C_{12}$–$C_{14}$EO(3) sulfate | 8.5 | 4.0–10.0 |
| Cetyl alcohol | 0.45 | 0.3–1.5 |
| PVP/VA[1] | 4.0 | 0–6.0 |
| Zinc pyridinethione[2] | 1.0 | 0–1.5 |
| Sodium citrate | 0.5 | 0–1.0 |
| Permethrin ®[3] | 0.45 | 0–1.0 |
| Silicone[4] | 1.0 | 0–2.0 |
| Ethylene glycol distearate | 3.0 | 0–4.0 |
| Water and Minors | Balance | |

*May be replaced by AQA2-10 or other AQA surfactants herein.
[1]Polyvinylpyrrolidone/vinyl acetate polymer (5/95).
[2]Per U.S. 4,345,080.
[3]Anti-lice agent from Fairfield American Company.
[4]Dimethicone from General Electric Company.

The following Example further illustrates the invention herein with respect to a personal cleansing bar or gel.

EXAMPLE XV

| Ingredient | % (wt.) | Range (% wt.) |
|---|---|---|
| AQA-1* | 1.5 | 1.0–3.0 |
| Coconut soap, Na** | 80.0 | 70–99 |
| $C_{12}$–$C_{14}$ methyl glucamide | 4.0 | 0–10 |
| Carboxymethyl cellulose | 2.0 | 0–5 |
| Perfume | 0.1 | Optional |
| Moisture and Minors | Balance | |

*May be replaced by AQA2-10 or other AQA surfactants herein.
**Soap may be replaced wholly or in part by synthetic anionic surfactants such as $C_{12}$–$C_{14}$ alkyl sulfates or $C_{12}$–$C_{16}$ alkyl ethoxy sulfates.

The following Examples further illustrate the invention herein with respect to a granular phosphate-containing automatic dishwashing detergent.

EXAMPLE XVI

| INGREDIENTS | % by weight of active material A | B |
|---|---|---|
| STPP (anhydrous)[1] | 31 | 26 |
| AQA-1* | | |
| Sodium Carbonate | 22 | 32 |
| Silicate (% $S_iO_2$) | 9 | 7 |
| Surfactant (nonionic) | 3 | 1.5 |
| NaDCC Bleach[2] | 2 | — |
| Sodium Perborate | — | 5 |
| TAED | — | 1.5 |
| Savinase (Au/g) | — | 0.04 |
| Termamyl (Amu/g) | | 425 |
| Sulfate | 25 | 25 |
| Perfume/Minors | to 100% | to 100% |

[1]Sodium tripoly phosphate
[2]Sodium dichloro cyanurate
*The AQA-1 surfactant of the Example may be replaced by an equivalent amount of any of surfactants AQA-2 through AQA-22 or other AQA surfactants herein.

The compositions of Examples I, II, IX and XVI herein can optionally be provided in the form of tablets. Such tablets can be prepared using standard tableting and compacting apparatus.

EXAMPLE XVII

The following Examples further illustrate the invention herein with respect to a liquid-gel automatic dishwashing or other detergent with increased levels of stain removal benefits.

| INGREDIENTS | % by weight of active material A | B | C | D | E | F | G |
|---|---|---|---|---|---|---|---|
| Citric acid | 16.5 | 16.5 | 16.5 | 16.5 | 16.5 | 10 | 10 |
| Na2CO3/K2CO3 | — | — | 25 | 25 | 25 | 15 | 15 |
| AQA-1* | 0.3 | 0.3 | 0.2 | 0.3 | 0.2 | 0.3 | 0.3 |
| Dispersant (480N) | 4 | 4 | 4 | 4 | 4 | 4 | 4 |
| HEDP/SS-EDDS | 2 | 2 | 0–2 | 2 | 2 | 1.5 | 1.5 |
| Benzoyl Peroxide | 8 | 8 | 8 | 8 | 8 | 1.5 | 1.5 |
| Butylated Hydroxy Toluene (BHT) | 0.05 | 0.05 | 0.05 | 0.05 | 0.05 | 0.05 | 0.05 |
| Surfactant | 2.5 | 2.5 | 1.5 | 1.5 | 1.5 | 1.5 | 1.5 |
| Boric Acid | — | 4 | 4 | 4 | 4 | 4 | 4 |
| Sorbitol | — | 6 | 6 | 6 | 6 | 6 | 6 |
| Savinase 24L | — | — | — | — | — | 0.53 | — |
| Slurried Savinase 16L | — | — | — | — | — | — | 0.53 |
| Maxamyl/Termamy | — | — | — | — | — | 0.31 | — |
| Slurried Termamyl | — | — | — | — | — | — | 0.31 |
| Water and minerals | | | | Balance | | | |

*The AQA-1 surfactant of the Example may be replaced by an equivalent amount of any of surfactants AQA-2 through AQA-22 or other AQA surfactants herein.

Various gelling agents such as CMC, clays, and the like, can be used in the compositions to provide varying degrees of viscosity or rigidity, according to the desires of the formulator.

EXAMPLE XVIII

The following illustrates mixtures of AQA surfactants which can be substituted for the AQA surfactants listed in any of the foregoing Examples. As disclosed hereinabove, such mixtures can be used to provide a spectrum of performance benefits and/or to provide cleaning compositions which are useful over a wide variety of usage conditions. Preferably, the AQA surfactants in such mixtures differ by at least about 1.5, preferably 2.5–20, total EO units. Ratio ranges (wt.) for such mixtures are typically 1:10:10:1. Non-limiting examples of such mixtures are as follows.

| Components | Ratio (wt.) |
|---|---|
| AQA-1 + AQA-5 | 1:1 |
| AQA-1 + AQA-10 | 1:1 |
| AQA-1 + AQA-15 | 1:2 |
| AQA-1 + AQA-5 + AQA-20 | 1:1:1 |
| AQA-2 + AQA-5 | 3:1 |
| AQA-5 + AQA-15 | 1.5:1 |
| AQA-1 + AQA-20 | 1:3 |

Mixtures of the AQA surfactants herein with the corresponding cationic surfactants which contain two ethoxylated chains (i.e., bis-ethoxylates) can also be used. Thus, for example, mixtures of ethoxylated cationic surfactants of the formula $R^1N^+CH_3[EO]_x[EO]_yX^-$ and $R^1N^+(CH_3)_2[EO]_zX^-$, wherein $R^1$ and X are as disclosed above and wherein one of the cationics has (x+y) or z in the range 1–5 preferably 1–2 and the other has (x+y) or z in the range 3–100, preferably 10–20, most preferably 14–16, can be used herein. Such compositions advantageously provide improved detergency performance (especially in a fabric laundering context) over a broader range of water hardness than do the cationic surfactants herein used individually. It has now been discovered that shorter EO cationics (e.g., EO2) improve the cleaning performance of anionic surfactants in soft water, whereas higher EO cationics (e.g., EO15) act to improve hardness tolerance of anionic surfactants, thereby improving the cleaning performance of anionic surfactants in hard water. Conventional wisdom in the detergency art suggests that builders can optimize the performance "window" of anionic surfactants. Until now, however, broadening the window to encompass essentially all conditions of water hardness has been impossible to achieve.

EXAMPLE XIX

Having thus described various non-limiting Examples of the compositions herein and their usage, the following further illustrates the inventions encompassed herein, with particular regard to fabric laundry detergents. Granular, liquid, bar, tablet or gel-form compositions herein can comprise detersive non-AQA surfactants and optional builders at usage levels and ranges as disclosed hereinabove, said compositions also comprising an effective amount of one or more of the following combinations of ingredients:

| Ingredient | Weight Ratio AQA: Ingredient |
|---|---|
| Percarbonate bleach | 1:100–1:1, preferably 1:20–1:5 |
| Branched alkyl sulfate | 1:100–1:2, preferably 1:10–1:3 |
| Bleach activator* | 2:1–1:10, preferably 1:1–1:5 |
| Peracid Bleach** | 1:10–2:1, preferably 1:5–1:1 |
| Photobleach | 1:100–1:2, preferably 1:5–1:1 |
| Layered silicate builder | 1:300–1:1, preferably 1:100–1:5 |
| SRA | 1:20–1:2, preferably 1:10–1:1 |
| Enzyme*** | 1:10–10:1, preferably 1:3–3:1 |
| EDDS | 1:20–10:1, preferably 1:3–3:1 |
| MGDA | 1:20–10:1, preferably 1:3–3:1 |

-continued

| Ingredient | Weight Ratio AQA: Ingredient |
|---|---|
| PFAA | 1:50–1:2, preferably 1:25–1:3 |
| APG | 1:50–1:2, preferably 1:25–1:3 |
| $Ca^{++}$ | 1:10–10:1, preferably 1:5–5:1 |
| $Mg^{++}$ | 1:10–10:1, preferably 1:5–5:1 |
| Co catalyst | 1:10–10:1, preferably 2:1–1:1 |
| Mn catalyst | 1:10–10:1, preferably 2:1–1:1 |
| DTI agent | 1:20–20:1, preferably 1:10–10:1 |
| Zeolite P (MAP) | 1:300–1:1,preferably 1:100–1:5 |
| Mineral Builder | 1:300–1:1, preferably 1:100–1:5 |
| Polymeric Dispersant**** | 1:10–10:1, preferably 1:5–1:1 |
| Alkoxylated Polycarboxylate | 4:1–10, preferably 1:5–1:1 |
| Clay Soil Removal/Anti-redeposition Agent | 4:1–1:20, preferably 1:1–1:10 |
| Clay Softener | 3:1–1:10, preferably 2:1–1:1 |

*Includes mixtures such as NOBS + TAED.
**Includes mixtures
***Ratios based on commercial enzyme preparations. This can vary, depending on the active enzyme level of the commercial enzyme preparation.
****Preferably polyacrylate or acrylic/maleic copolymer.

The laundry detergent compositions prepared using one or more foregoing combinations of ingredients can optionally be built with any non-phosphate or phosphate builders, or mixtures thereof, typically at levels of from 5% to about 70%, by weight of finished composition.

EXAMPLE XX

The following illustrates mixtures of conventional non-AQA surfactants which can be used in combination with the AQA surfactants in any of the foregoing Examples, but is not intended to be limiting thereof The ratios of non-AQA surfactants. in the mixtures are noted in parts by weight of the surfactant mixtures.

| Mixtures A–C | |
|---|---|
| Ingredients | Ratios |
| AS*/LAS | 1:1 |
| AS/LAS | 10:1 (pref. 4:1) |
| AS/LAS | 1:10 (pref. 1:4) |

*In the foregoing, the primary, substantially linear AS surfactant can be replaced by an equivalent amount of secondary AS, branched-chain AS, oleyl sulfate, and/or mixtures thereof, including mixtures with the linear, primary AS shown above. The "tallow" chain length AS is particularly useful under hot water conditions, up to the boil. "Coconut" AS is preferred for cooler wash temperatures.Preferably, the LAS surfactant is mixed with the AQA surfactant before the AS surfactant is added.

The mixtures of alkyl sulfate/anionic surfactants noted above are modified by incorporating a nonionic non-AQA surfactant therein at a weight ratio of anionic (total) to nonionic in the range of about 25:1 to about 1:5. The nonionic surfactant can comprise any of the conventional classes of ethoxylated alcohols or alkyl phenols, alkylpolyglycosides or polyhydroxy fatty acid amides (less preferred if LAS is present), or mixtures thereof, such as those disclosed hereinabove.

| Mixtures D–F | |
|---|---|
| AS*/AES | 1:1 |
| AS/AES | 10:1 (pref. 4:1) |
| AS/AES | 1:10 (pref. 1:4) |

*Can be replaced by secondary, branched or oleyl AS, as noted above.

The mixtures of AS/AES noted above can be modified by incorporating LAS therein at a weight ratio of AS/AES (total) to LAS in the range from about 1:10 to about 10:1.

The mixtures of AS/AES or their resulting AS/AES/LAS mixtures can also be combined with nonionic surfactants as noted for Mixtures A–C at weight ratios of anionic (total) to nonionic in the range of about 25:1 to about 1:5.

Any of the foregoing mixtures can be modified by the incorporation therein of an amine oxide surfactant, wherein the amine oxide comprises from 1% to about 50% of the total surfactant mixture.

Highly preferred combinations of the foregoing non-AQA surfactants will comprise from about 3% to about 60%, by weight, of the total finished laundry detergent composition. The finished compositions will preferably comprise from about 0.25% to about 3.5%, by weight, of the AQA surfactant.

EXAMPLE XXI

This Example illustrates perfume formulations (A–C) made in accordance with the invention for incorporation into any of the foregoing Examples of AQA-containing detergent compositions. The various ingredients and levels are set forth below.

| | (% Weight) | | |
|---|---|---|---|
| Perfume Ingredient | A | B | C |
| Hexyl cinnamic aldehyde | 10.0 | — | 5.0 |
| 2-methyl-3-(para-tert-butylphenyl)-propionaldehyde | 5.0 | 5.0 | — |
| 7-acetyl-1,2,3,4,5,6,7,8-octahydro-1,1,6,7-tetramethyl naphthalene | 5.0 | 10.0 | 10.0 |
| Benzyl salicylate | 5.0 | — | — |
| 7-acetyl-1,1,3,4,4,6-hexamethyltetralin | 10.0 | 5.0 | 10.0 |
| Para-(tert-butyl) cyclohexyl acetate | 5.0 | 5.0 | — |
| Methyl dihydro jasmonate | — | 5.0 | — |
| Beta-napthol methyl ether | — | 0.5 | — |
| Methyl beta-naphthyl ketone | — | 0.5 | — |
| 2-methyl-2-(para-iso-propylphenyl)-propionaldehyde | — | 2.0 | — |
| 1,3,4,6,7,8-hexahydro-4,6,6,7,8,8-hexamethyl-cyclopenta-gamma-2-benzopyrane | — | 9.5 | — |
| Dodecahydro-3a,6,6,9a-tetramethyinaphtho-[2,1b]furan | — | — | 0.1 |
| Anisaldehyde | — | — | 0.5 |
| Coumarin | — | — | 5.0 |
| Cedrol | — | — | 0.5 |
| Vanillin | — | — | 5.0 |
| Cyclopentadecanolide | 3.0 | — | 10.0 |
| Tricyclodecenyl acetate | — | — | 2.0 |
| Labdanum resin | — | — | 2.0 |
| Tricyclodecenyl propionate | — | — | 2.0 |
| Phenyl ethyl alcohol | 20.0 | 10.0 | 27.9 |
| Terpineol | 10.0 | 5.0 | — |
| Linalool | 10.0 | 10.0 | 5.0 |
| Linalyl acetate | 5.0 | — | 5.0 |
| Geraniol | 5.0 | — | — |
| Nerol | — | 5.0 | — |
| 2-(1,1-dimethylethyl)-cyclohexanol acetate | 5.0 | — | — |
| Orange oil, cold pressed | — | 5.0 | — |
| Benzyl acetate | 2.0 | 2.0 | — |

-continued

| Perfume Ingredient | (% Weight) A | B | C |
|---|---|---|---|
| Orange terpenes | — | 10.0 | — |
| Eugenol | — | 1.0 | — |
| Diethylphthalate | — | 9.5 | — |
| Lemon oil, cold pressed | — | — | 10.0 |
| Total | 100.0 | 100.0 | 100.0 |

The foregoing perfume compositions are admixed or sprayed-onto (typically at levels up to about 2% by weight of the total detergent composition) any of the AQA surfactant-containing cleaning (including bleaching) compositions disclosed herein. Improved deposition and/or retention of the perfume or individual components thereof on the surface being cleaned (or bleached) is thus secured.

EXAMPLE XXII

The following illustrates bleach compositions which can be used alone or in combination with the detergent compositions herein. Such bleach compositions can comprise, for example, any of the bleach activators herein or their corresponding per-acids (also known as "preformed per-acids"). It is preferred, but not essential, that the mole ratio of AQA surfactant:activator or peracid be about 1:1.

| Composition (wt.) | Bleach Ingredient | AQA | Ratio Range Bleach:AOA |
|---|---|---|---|
| A | TAED | AQA1 | 5:1–1:5 |
| B | NOBS | AQA1 | 5:1–1:5 |
| C | TAED/NOBS (1:1) | AQA15 | 3:1–1:3 |
| D | Peracetic acid | AQA1 | 3:1–1:20 |
| E | Pernonanoic acid | AQA1 | 5:1–1:5 |
| F | Peracetic/Pernonanoic (1:1) | AQA15 | 3:1–1:3 |
| G | Perbenzoic | AQA1 | 2:1–1:10 |
| H | Octanamido oxybenzene sulfonate* | AQA1 | 5:1–1:5 |
| I | Octanamido oxybenzene sulfonate* | AQA15 | 5:1–1:5 |

*As disclosed hereinabove as bleach activator.

What is claimed is:

1. A detergent composition comprising, or prepared by combining, a linear or branched chain alkyl sulfate surfactant, an alkyl benzene sulfonate surfactant and an effective amount of an alkoxylated AQA cationic surfactant of the formula:

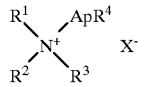

wherein $R^1$ is a $C_8$–$C_{18}$ alkyl or alkenyl moiety, $R^2$ and $R^3$ are each independently $C_1$–$C_3$ alkyl, $R^4$ is selected from hydrogen, methyl and ethyl, X is an anion, A is $C_1$–$C_4$ alkoxy and p is from 2 to about 30, and a builder which comprises a mixture of zeolite and layered silicate, said composition further comprising an effective amount of a detersive or fabric care adjunct ingredient which is a member selected from the group consisting of: percarbonate bleaches; bleach activators; photobleaches; soil release agents; enzymes; chelants; clay soil removal/antiredeposition agents; polyhydroxy fatty acid amides; alkyl polyglucosides; $Ca^{++}$; $Mg^{++}$; Co catalysts; Mn catalysts; dye transfer inhibitors; mineral builders; polymeric dispersants; peracid bleaches; clay fabric softeners; optical brighteners; and mixtures thereof.

2. A composition according to claim 1 which is substantially free of a bleach ingredient.

3. A composition according to claim 1 in a granular, bar, aqueous liquid or non-aqueous liquid, or tablet form.

4. A composition according to claim 1 wherein, in said AQA cationic surfactant, $R^1$ is $C_{10}$–$C_{18}$ alkyl, $R^2$ is methyl and p is 1 to about 4 and A is ethoxy.

5. A method for removing soils and stains by contacting said soils and stains with a detergent composition, or aqueous medium comprising said detergent composition, according to claim 1.

6. A method according to claim 5 for removing body soil, builder sensitive soil, bleach sensitive soil or surfactant sensitive soil from fabrics.

7. A method according to claim 5 for cleaning dishware or other hard surfaces.

8. A method according to claim 5 which employs amylase, protease, lipase or cellulase or cellulytic enzymes, or mixtures thereof, as the adjunct ingredient.

9. A method according to claim 5 which employs an ethoxylated polyamine as the adjunct ingredient.

* * * * *